US011749480B1

(12) United States Patent
Gottschalk et al.

(10) Patent No.: US 11,749,480 B1
(45) Date of Patent: Sep. 5, 2023

(54) DIRECT DRIVEN LATCH FOR ULTRA-FAST SWITCH

(71) Applicant: EATON INTELLIGENT POWER LIMITED, Dublin (IE)

(72) Inventors: Andrew L. Gottschalk, Monaca, PA (US); Xin Zhou, Wexford, PA (US); Robert Michael Slepian, Murrysville, PA (US); Santhosh Kumar Chamarajanagar Govinda Nayaka, Moon Township, PA (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 17/837,225

(22) Filed: Jun. 10, 2022

(51) Int. Cl.
*H01H 50/32* (2006.01)
*H01H 50/02* (2006.01)
*H01H 50/54* (2006.01)

(52) U.S. Cl.
CPC ..... *H01H 50/32* (2013.01); *H01H 50/02* (2013.01); *H01H 50/54* (2013.01)

(58) Field of Classification Search
CPC ..... H01H 50/32; H01H 9/22; H01H 71/505; H01H 2071/506–507
USPC ..... 335/167
See application file for complete search history.

(56) References Cited

U.S. PATENT DOCUMENTS 3,012,800 A * 12/1961 Koch ..... H01H 50/30 29/523
5,713,459 A * 2/1998 Beck ..... H01H 71/505 200/400
8,471,654 B1 * 6/2013 Shanmugaraj ..... H01H 71/1054 335/170
8,629,743 B2 * 1/2014 Staffas ..... H01H 3/00 335/172
2018/0122610 A1 * 5/2018 Sun ..... H01H 71/521

* cited by examiner

*Primary Examiner* — Alexander Talpalatski
(74) *Attorney, Agent, or Firm* — Eckert Seamans Cherin & Mellott, LLC

(57) ABSTRACT

A latching assembly for latching the moving conductor assembly of a circuit interrupter after an opening stroke includes a streamlined latch that omits components commonly prone to damage during latching operations in existing latching assemblies. The disclosed latching assembly comprises a fixed latch block, a driven latch rotatably coupled to the latch block, and a pivoting hammer with a square pin positioned to always be engaged with the driven latch. The latching assembly is structured to be engaged by a switch shaft once an opening stroke is initiated. When the latching assembly engages, the hammer square pin pushes the driven latch into engagement with a shelf formed in the switch shaft, which prevents the switch shaft from rebounding after the opening stroke. Rebounding is further prevented due to the hammer being structured to be biased toward the open state once the driven latch has engaged the switch shaft shelf.

20 Claims, 17 Drawing Sheets

DIRECT DRIVEN LATCH FOR ULTRA-FAST SWITCH

FIELD OF THE INVENTION

The disclosed concept relates generally to circuit interrupters, and in particular, to latching mechanisms for moving conductor assemblies used in circuit interrupters.

BACKGROUND OF THE INVENTION

Circuit interrupters, such as for example and without limitation, circuit breakers, are typically used to protect electrical circuitry from damage due to an overcurrent condition, such as an overload condition, a short circuit, or another fault condition, such as an arc fault or a ground fault. Referring to FIG. 1, circuit interrupters such as the schematically depicted circuit interrupter 1 are generally structured to be electrically connected between a power source 2 and a load 3 via line and neutral conductors 4, 6. Circuit interrupters typically include separable electrical contacts 8, which operate as a switch. When the separable contacts 8 are in contact with one another in a closed state, current is able to flow through any circuits connected to the circuit interrupter. When the separable contacts 8 are isolated from one another in an open state, current is prevented from flowing through any circuits connected to the circuit interrupter. Typically, circuit interrupters include an actuator 10 designed to rapidly close or open the separable contacts 8, and a trip mechanism, such as an electronic trip unit 12, which uses a current sensor 14 or other type of sensor to detect a number of fault conditions. Upon sensing a fault condition, the trip unit 12 is configured to send a command signal to the actuator 10 to automatically trip open the separable contacts 8.

Typically, one of the separable contacts 8 is fixed in place and remains stationary, and the other separable contact 8 is part of a movable conductor assembly including an electrode stem and a contact disposed on one end of the electrode stem. A drive assembly is operatively coupled to the other end of the movable electrode stem. When the trip unit 12 detects a fault condition and initiates an opening stroke by commanding the actuator 10 to open the separable contacts 8, the actuator 10 causes the drive assembly to open the separable contacts 8 by driving the movable conductor assembly away from the fixed separable contact. The actuator 10 and drive assembly need to be capable of driving the movable conductor assembly away from the fixed separable contact quickly in order to mitigate the effects of a fault condition.

Due to the substantial mass of movable conductor assemblies and drive assemblies, the force required to open the mechanical separable contacts 8 is significant. A latching mechanism is required to latch the movable conductor assembly at the end of an opening stroke in order to maintain the movable electrode in an open state, as significant force is applied to open the movable conductor assembly and could cause the movable assembly to rebound at the end of an opening stroke and re-close the separable contacts 8 before the fault condition has been cleared. Latching assemblies require several components to move in well-coordinated sequence with one another during an opening stroke, and when any of the latching components do not function as precisely and/or as quickly as they are supposed to, the malfunction results in some components not being positioned where they need to be at designated stages in the opening stroke sequence, thereby creating a risk that some components will sustain significant damage due to the impact exerted by the movable conductor assembly upon a rebound.

There is thus room for improvement in latching mechanisms for movable conductor assemblies in circuit interrupters.

SUMMARY OF THE INVENTION

These needs, and others, are met by a latching assembly for a circuit interrupter that comprises a driven latch with a streamlined design that greatly reduces the chance of a latching malfunction by omitting components commonly prone to damage during latching operations in existing latching assemblies. In addition to the driven latch, the disclosed latching assembly comprises a fixed latch block and a pivoting hammer with a square pin positioned to be in constant contact with the driven latch. The driven latch is rotatably coupled to the latch block. The latching assembly is structured to be engaged by a switch shaft of the circuit interrupter after an opening stroke of the circuit interrupter moving conductor assembly is initiated. The square pin of the hammer is configured to push the driven latch into engagement with a groove formed in the switch shaft once the switch shaft engages the latching assembly, which prevents the switch shaft from rebounding after the opening stroke concludes. In addition, the hammer is structured to be biased toward the open state when the driven latch has engaged the switch shaft, thus further preventing rebounding of the switch shaft.

In accordance with one aspect of the disclosed concept, a latching assembly for latching a moving conductor assembly of a circuit interrupter is structured to be disposed within a housing of the circuit interrupter and comprises: a latch block structured to be fixedly positioned relative to the circuit interrupter housing, a driven latch rotatably coupled to the latch block, a hammer, and a rotation pin structured to fixedly position the hammer relative to the circuit interrupter housing and to form a fixed axis about which the hammer can rotate. The hammer comprises two planar sides disposed parallel to one another, and a square pin. The square pin is coupled at a first end to a first of the two planar sides and is coupled at a second end to a second of the two planar sides. The driven latch is disposed between the two hammer planar sides and comprises a medial side structured to face toward a switch shaft of the moving conductor assembly and a lateral side disposed opposite the medial side structured to face away from the switch shaft. The hammer and the driven latch are structured such that the hammer square pin is always in engagement with the lateral side of the driven latch.

In accordance with another aspect of the disclosed concept, a circuit interrupter comprises: a housing, a pair of separable contacts comprising a stationary separable contact and a moving separable contact, a moving assembly including a moving conductor comprising the moving separable contact and a switch shaft operably coupled to the moving conductor, an actuator structured to actuate the moving assembly to open and close the separable contacts, an electronic trip unit structured to activate the actuator, and a latching assembly structured to be engaged by the switch shaft. The latching assembly comprises: a latch block structured to be fixedly positioned relative to the circuit interrupter housing, a driven latch rotatably coupled to the latch block, a hammer, and a rotation pin structured to fixedly couple the hammer to the circuit interrupter housing and to form a fixed axis about which the hammer can rotate. The hammer comprises: two planar sides disposed parallel to one another, and a square pin. The square pin is coupled at a first end to a first of the two hammer planar sides and coupled at a second end to a second of the two hammer planar sides. The driven latch is disposed between the two hammer planar sides, and comprises a medial side structured to face toward the switch shaft and a lateral side disposed opposite the medial side structured to face away from the switch shaft. The hammer and the driven latch are structured such that the hammer square pin is always in engagement with the lateral side of the driven latch.

In accordance with a further aspect of the disclosed concept, a latching assembly for latching a moving conductor assembly of a circuit interrupter is structured to be disposed within a housing of the circuit interrupter and comprises: a latch block structured to be fixedly positioned relative to the circuit interrupter housing, a driven latch rotatably coupled to the latch block, a hammer, and a rotation pin structured to fixedly position the hammer relative to the circuit interrupter housing and to form a fixed axis about which the hammer can rotate. The hammer comprises: two planar sides disposed parallel to one another; a square pin, the square pin being coupled at a first end to a first of the two planar sides and being coupled a second end to a second of the two planar sides; and a plurality of rounded pins, each of the rounded pins being coupled at a first end to a first of the two planar sides and being coupled a second end to a second of the two planar sides. The plurality of rounded pins comprises: a paddle engagement pin coupled to a first end of each of the two planar sides, a cam engagement pin coupled to a second end of each of the two planar sides disposed opposite the first end, and a number of interior hammer pins coupled to the planar sides in between the square pin and the cam engagement pin. The latching assembly is structured so as to receive a switch shaft of the moving conductor assembly in between the square pin and the interior hammer pins. The driven latch is disposed between the two hammer planar sides and comprises a medial side structured to face toward the switch shaft and a lateral side disposed opposite the medial side structured to face away from the switch shaft. The hammer and the driven latch are structured such that the hammer square pin is always in engagement with the lateral side of the driven latch.

BRIEF DESCRIPTION OF THE DRAWINGS

A full understanding of the invention can be gained from the following description of the preferred embodiments when read in conjunction with the accompanying drawings in which.

DETAILED DESCRIPTION OF THE INVENTION

Figure 1:
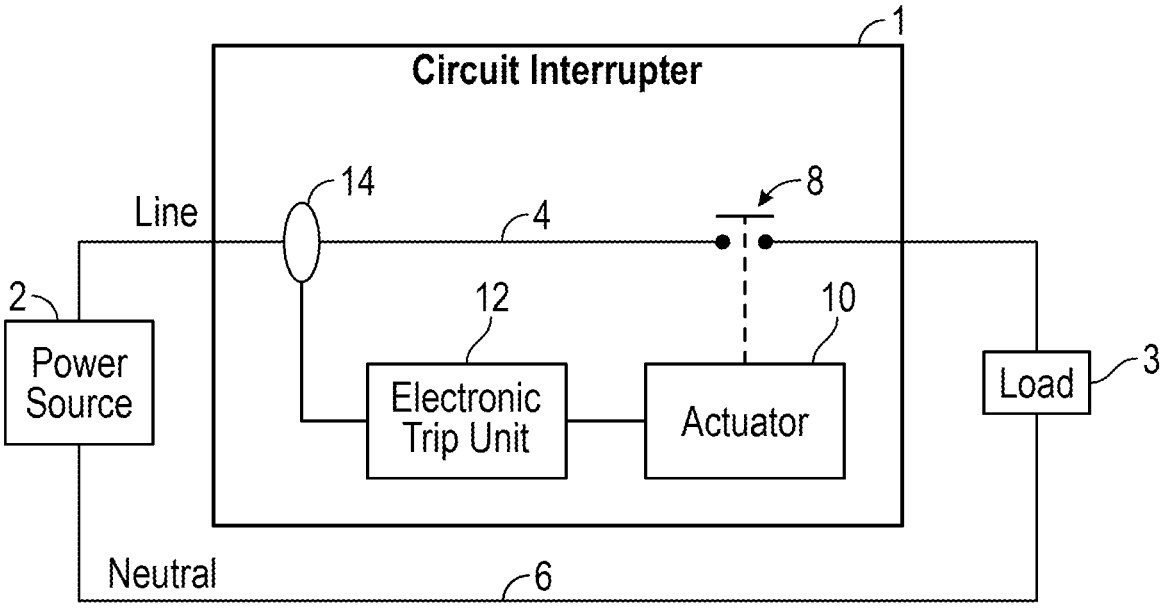
FIG. 1 is a schematic diagram of a circuit interrupter.

Directional phrases used herein, such as, for example, left, right, front, back, top, bottom and derivatives thereof, relate to the orientation of the elements shown in the drawings and are not limiting upon the claims unless expressly recited therein.

As employed herein, the statement that two or more parts are "coupled" together shall mean that the parts are joined together either directly or joined through one or more intermediate parts.

As employed herein, when ordinal terms such as "first" and "second" are used to modify a noun, such use is simply intended to distinguish one item from another, and is not intended to require a sequential order unless specifically stated.

As employed herein, the term "number" shall mean one or an integer greater than one (i.e., a plurality).

Figure 2A:
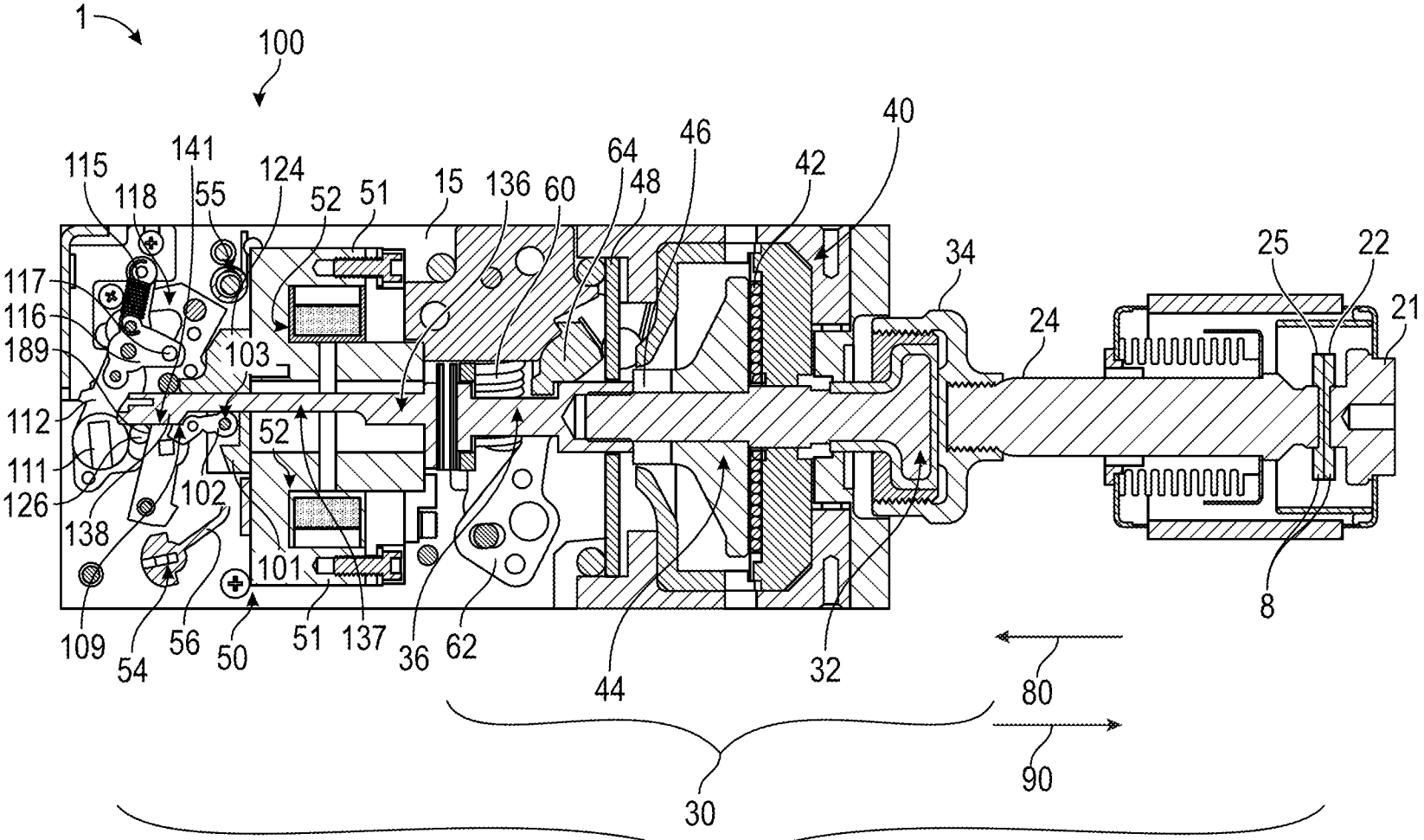
FIG. 2A is a sectional view of a movable conductor assembly and an improved latching assembly using a direct-driven latch, for use with a circuit interrupter such as the circuit interrupter schematically depicted in FIG. 1, in accordance with an example embodiment of the disclosed concept.

Referring now to FIG. 2A, a sectional view of a portion of a circuit interrupter, such as the circuit interrupter 1 schematically depicted in FIG. 1, is shown. Some subassemblies of the circuit interrupter 1 comprise their own housing, and in FIG. 2A, an actuator housing 15 is shown. In the sectional view shown in FIG. 2A, only a single wall of the housing 15 is visible, while more sections of the housing 15 are visible in FIG. 2B and FIG. 3. FIG. 2A shows a latching assembly 100 according to an exemplary embodiment of the disclosed concept, in addition to a stationary conductor 21 comprising a fixed contact 22, a movable conductor 24, and a drive assembly 30. The terms "proximal" and "distal" are used hereinafter to refer to specific ends of components of the circuit interrupter 1 as depicted in FIG. 2A. Specifically, as used herein regarding a component of the circuit interrupter 1, the term "proximal" refers to the end of the component that is disposed closest to the stationary conductor 21 as shown in FIG. 2A. Accordingly, as used herein regarding a component of the circuit interrupter 1, the term "distal" refers to the end of the component that is disposed furthest from the stationary conductor 21 as shown in FIG. 2A. It will be appreciated that, for a given component, the proximal end of the component and the distal end of the component are disposed opposite of one another.

Still referring to FIG. 2A, the movable conductor 24 comprises an electrode stem with a moving contact 25 disposed at the proximal end of the electrode stem. The fixed contact 22 and the moving contact 25 collectively comprise the separable contacts 8 schematically depicted in FIG. 1. The distal end of the moving electrode stem 24 is coupled to the proximal end of an isolation shaft 32 via an isolation coupling 34, and the distal end of the isolation shaft 32 is coupled to the proximal end of a drive shaft 36. The drive assembly 30 comprises the isolation shaft 32, isolation coupling 34, and the drive shaft 36, among other components. The distal end of the drive shaft 36 is coupled to the proximal end of a switch shaft 136, and the distal end of the switch shaft 136 engages the latching assembly 100 during an opening stroke (as detailed further later herein). The movable conductor 24, the drive assembly 30, and the switch shaft 136 can be collectively referred to as the moving assembly 38.

The actuator 10 schematically depicted in FIG. 1 can comprise any one of a number of mechanisms, and the actuator shown in FIG. 2A is a Thomson coil actuator 40. The Thomson coil actuator 40 comprises a Thomson coil 42 and a conductive plate 44 mechanically coupled to the isolation shaft 32. An impact washer 46 is coupled to the conductive plate 44, and a stop plate 48 is fixed in place relative to the actuator housing 15. When a fault condition is detected by the trip unit 12 (FIG. 1), the trip unit 12 causes an activating current to be supplied to the Thomson coil 42 in order to generate a magnetic force to repulse the conductive plate 44 away from the Thomson coil 42. The magnetic force initiates an opening stroke of the circuit interrupter 1 by causing the moving assembly 38 to move in the direction indicated by arrow 80 (referred to hereinafter as the "opening direction 80"), thus physically separating and electrically isolating the moving contact 25 and the fixed contact 22 from one another. During an opening stroke, the maximum distance that the moving assembly 38 can travel is the distance it takes for the washer 46 to impact the stop plate 48.

It should be noted that references made herein to an "opening stroke" or to "opening" the circuit interrupter 1 or any of its components refers to movement of the moving assembly 38 in the opening direction 80. Accordingly, when a component is referred to as being "open", in an "open state", or in an "open position", it is to be understood that the disposition of the component indicates that the fixed and moving contacts 24, 25 are separated. Conversely, when a component is referred to as being "closed", in the "closed state", or in a "closed position", it is to be understood that the disposition of the component indicates that the fixed and moving contacts 24, 25 are in contact with one another. In addition, the direction heading opposite of the opening direction 80 is indicated by the arrow 90 in FIG. 2A. This opposing direction is referred to hereinafter as the "closing direction 90", to denote the closing of the separable contacts 8 that results from the moving assembly 38 traveling a sufficient distance in the closing direction 90. Further, as used herein, the term "rebound" refers to travel of the moving assembly 38 in the closing direction 90 that results from the impact between components after the moving assembly 38 has reached the end of an opening stroke. It is understood that minimizing rebounding is generally desirable, as rebounding too great a distance can result in unintentional re-closing of the separable contacts 8 before a fault condition is cleared. Furthermore, as used herein, the terms "lateral" or "laterally", when used to describe movement or a plane, refers to a direction or plane that is disposed perpendicularly to the opening direction 80 and the closing direction 90.

Figure 2B:
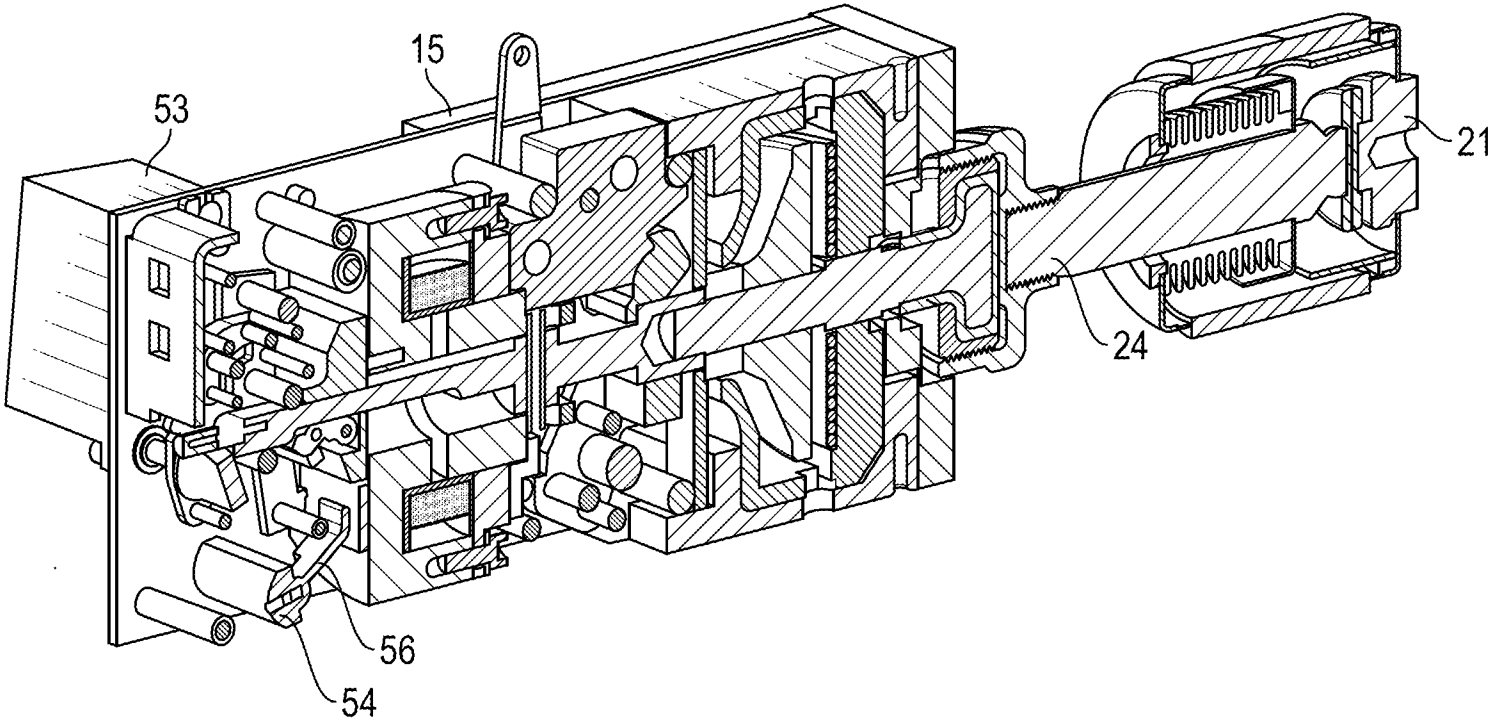
FIG. 2B is an isometric perspective of the sectional view of the portion of the circuit interrupter shown in FIG. 2A with a hammer of the latching assembly removed, showing more portions of an actuator housing and a closing solenoid coupled to the actuator housing not visible in the view shown in FIG. 2A.
Figure 3:
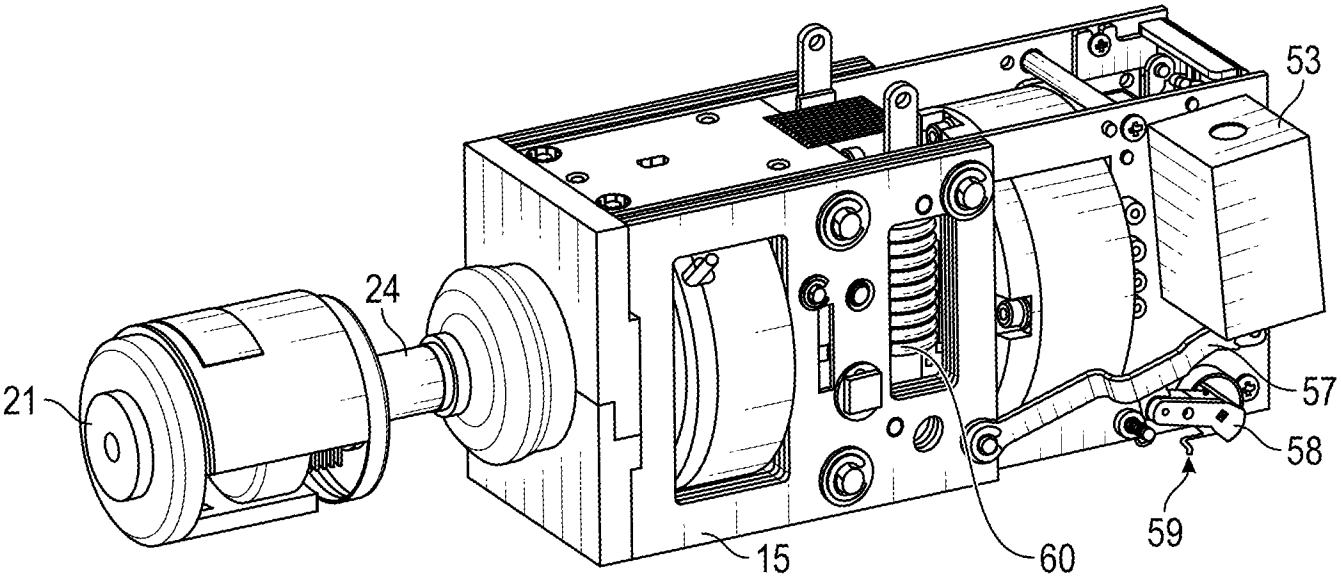
FIG. 3 is an alternative isometric view of the portion of the circuit interrupter shown in FIGS. 2A and 2B, showing the entire actuator housing and mechanical linkages between the closing solenoid and a solenoid paddle disposed in the interior of the actuator housing.

As detailed further hereinafter, the latching assembly 100 and the moving assembly 38 are structured such that, during an opening stroke, the movement of the switch shaft 136 in the opening direction 80 will cause the switch shaft 136 to engage the latching assembly 100, thus ensuring that the moving assembly 38 remains in an open state until the fault condition is cleared and the latching assembly 100 is purposely disengaged, since the impact between the impact washer 46 and the stop plate 48 during an opening stroke could otherwise cause the moving assembly 38 to rebound back toward a closed position. Referring to FIG. 2B and FIG. 3 in addition to FIG. 2A, the circuit interrupter 1 further includes a slow opening solenoid assembly 50 comprising a solenoid housing 51 and a slow open solenoid 52, a closing solenoid 53, a solenoid paddle 54 comprising an arm 56, and a hammer reset assembly 55. Whereas the Thomson coil actuator 40 is used for fast opening during abnormal conditions such as a fault, overload, short circuit, etc., the slow opening solenoid assembly 50 is used during normal opening operations, i.e. rated current switching operations. As shown in FIG. 3, the circuit interrupter 1 further comprises a closing solenoid link 57, a paddle link 58, and a solenoid link return spring 59 that enable actuation of the solenoid paddle 54, as detailed further herein with respect to FIGS. 6A-6D. The use of the slow opening assembly 50, closing solenoid 53, solenoid paddle 54, and hammer reset assembly 55 during a de-latching and re-closing operation are also detailed further herein with respect to FIGS. 6A-6D. The circuit interrupter 1 further includes a contact spring 60, a spring fork 62, and a transfer shaft 64. Although the mechanics are not detailed further herein, one of the functions of the contact spring 60, spring fork 62, and transfer shaft 64 is to bias the moving assembly 38 to the closed position such that, when the moving assembly 38 is not latched by the latching assembly 100, the moving assembly 38 will move into the closed position.

Figure 4:
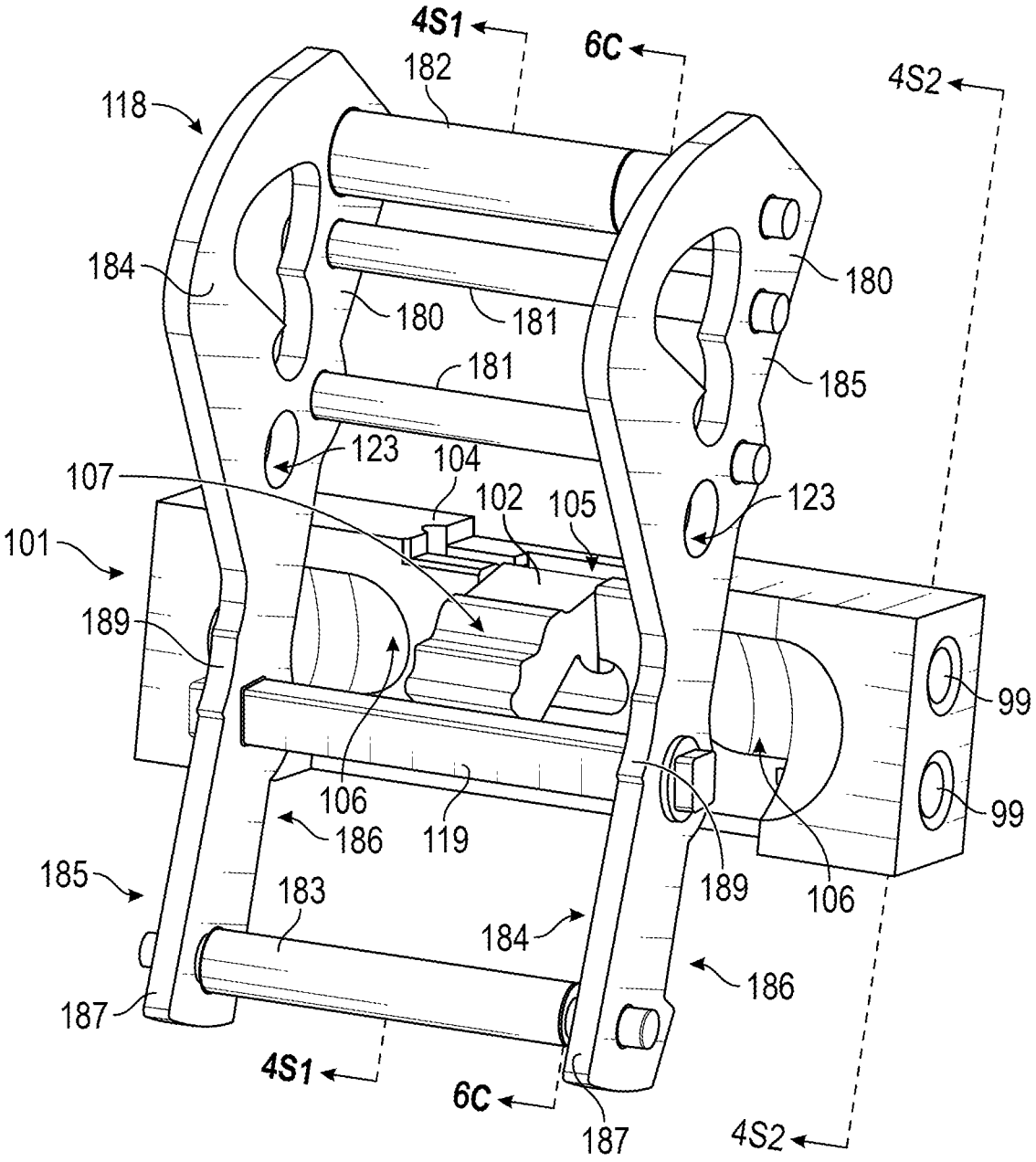
FIG. 4 is an enlarged isometric view of a latch block, a direct driven latch, and a hammer of the latching assembly shown in FIG. 2A.

Referring now to FIG. 4 in addition to FIG. 2A, the latching assembly 100 comprises a latch block 101, a driven latch 102, and a hammer 118 (although hammer 118 will be described in further detail later herein in conjunction with a description of FIGS. 5A-5F). The latch block 101 is fixed in position relative to the actuator housing 15. In one non-limiting example, the latch block 101 is formed with a plurality of apertures 99 structured to receive pins fixedly coupled to the actuator housing 15. The driven latch 102 is rotatably coupled to the latch block 101 such that the driven latch 102 can rotate about an axis relative to the latch block 101. In one non-limiting example, the driven latch 102 can be coupled to the latch block 101 via a pin 103 (not visible in FIG. 4 but shown and numbered in FIGS. 5A-5D) that is coupled to the driven latch 102 and inserted into a slot 104 (numbered in FIG. 4) formed in the latch block 101.

The latch block 101 is formed with a pocket 105 (numbered in FIG. 4) structured to receive the proximal end of the driven latch 102, and the pocket 105 is sized such that the driven latch 102 cannot move laterally within the latch block 101, i.e. cannot move in a direction coinciding with the longitudinal axis of pin 103. The latch block 101 is also formed with two depressions 106 on its distal side. The driven latch 102 comprises at least two surfaces, a medial surface 107 (shown and numbered in FIG. 4) that is structured to face toward the switch shaft 136 and a lateral surface 108 that is structured to face away from the switch shaft 136 (not visible in FIG. 4 but shown and numbered in FIGS. 5A and 5C).

Figure 5A:
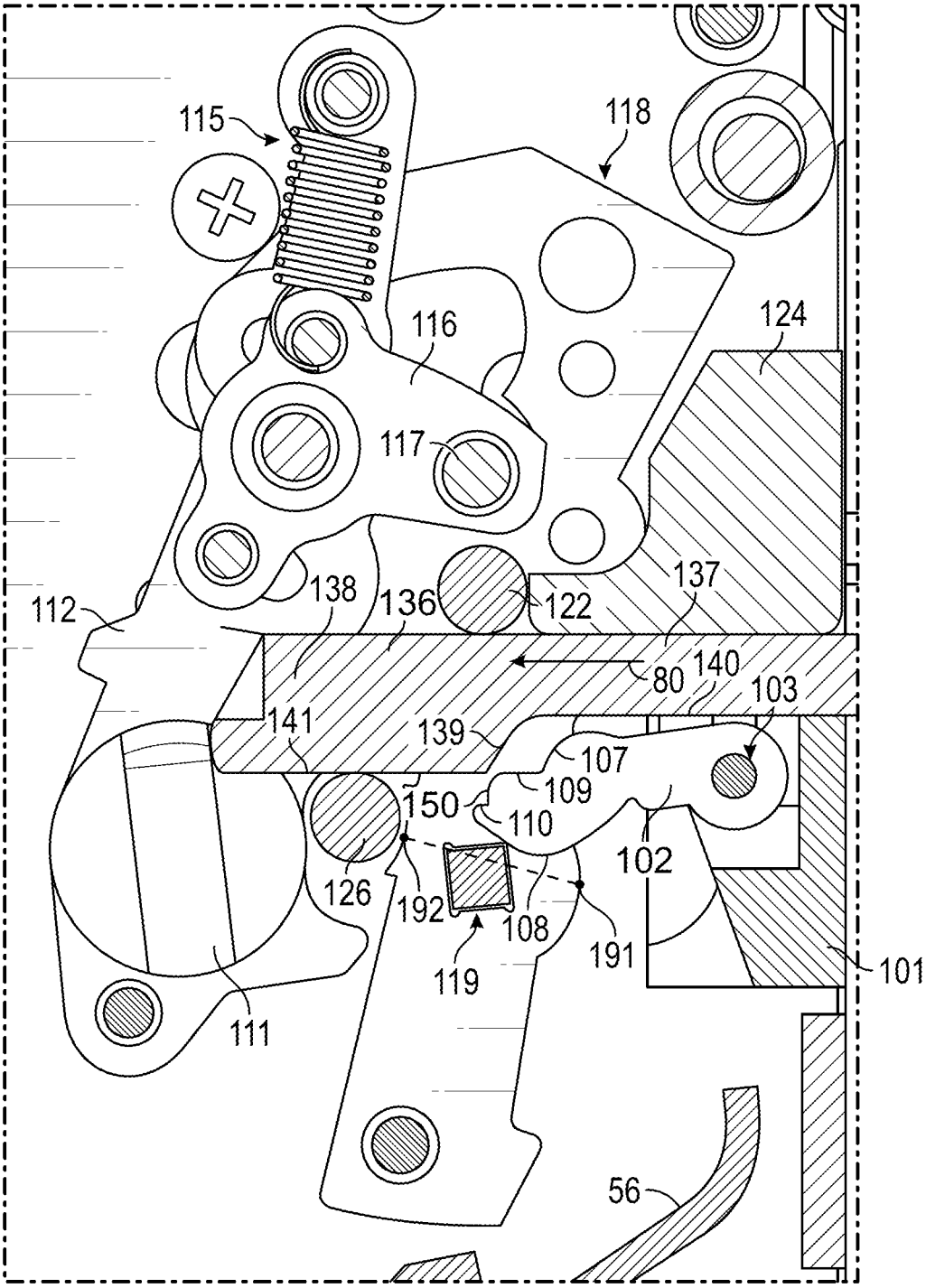
FIG. 5A is an enlarged sectional view of the latching assembly shown in FIG. 2A, taken along the viewing plane 4S1-4S1 denoted in FIG. 4, showing a switch shaft of the circuit interrupter in an initial open state and moving toward a fully open position during an opening stroke of the movable conductor assembly shown in FIG. 2A, in accordance with an example embodiment of the disclosed concept.
Figure 5B:
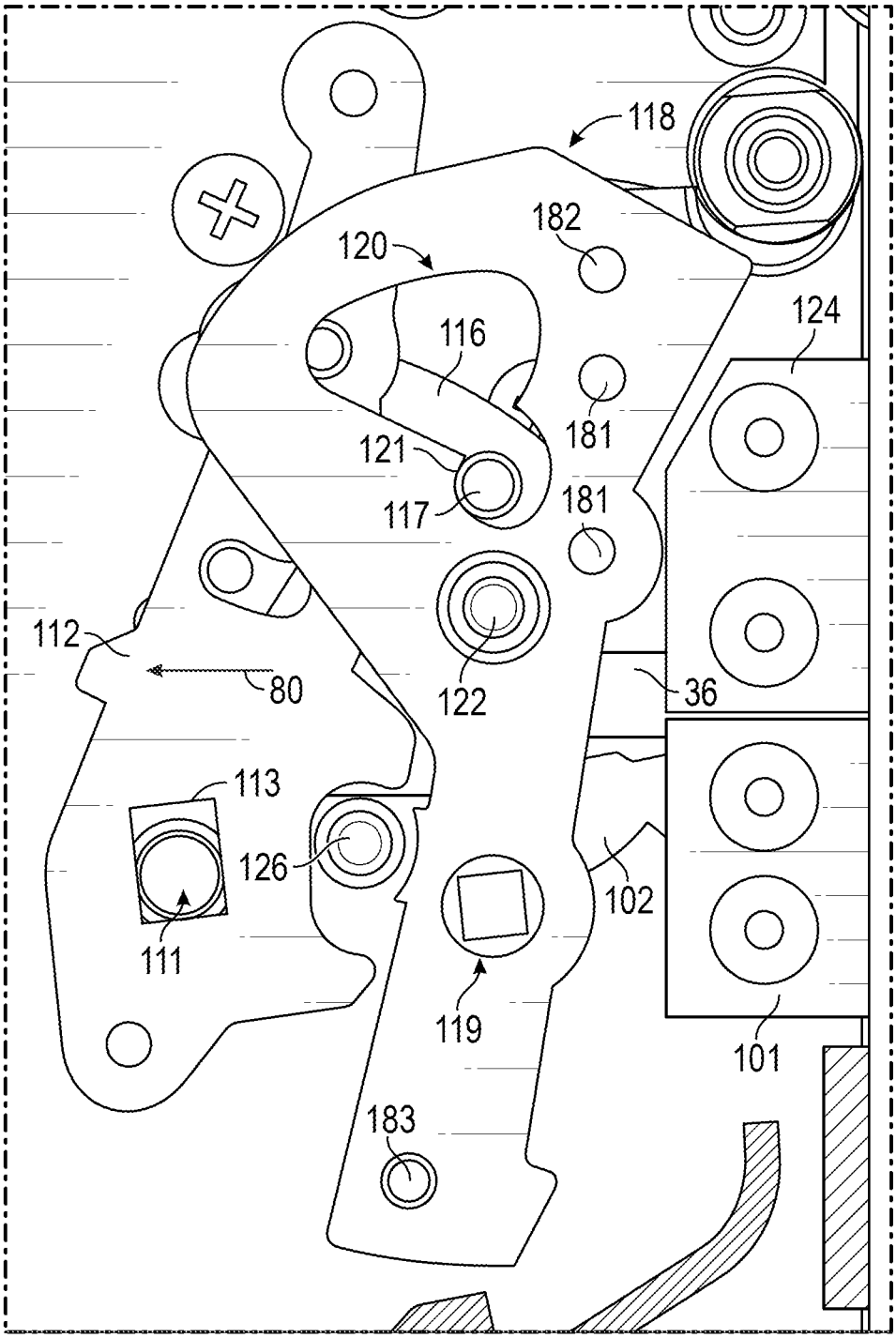
FIG. 5B is an elevation view of the latching assembly during the same initial opening stage of the opening stroke shown in FIG. 5A, taken along the plane 4S2-4S2 denoted in FIG. 4.
Figure 5C:
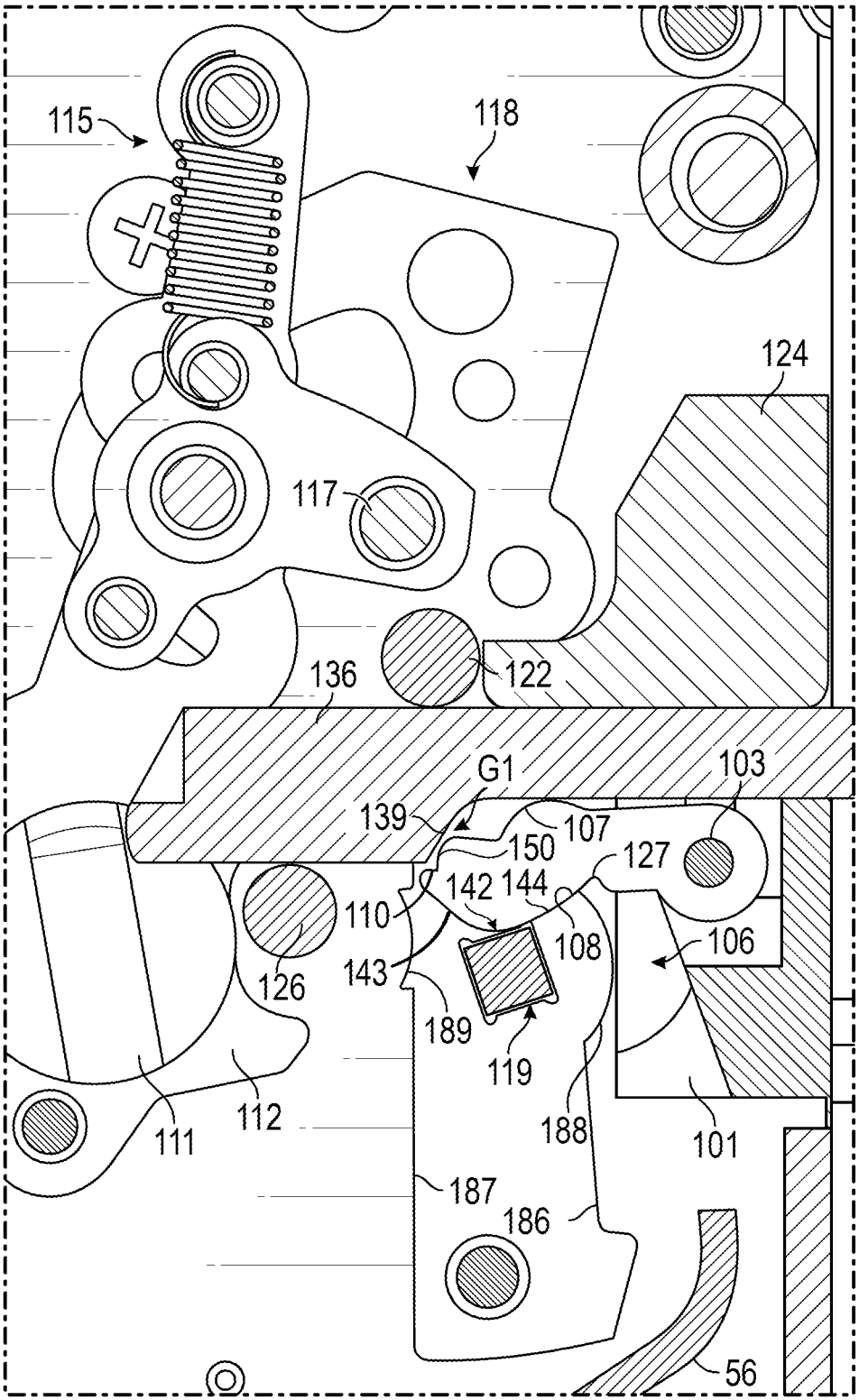
FIG. 5C shows the same sectional view of the latching assembly shown in FIG. 5A at an intermediary stage of the process of fully latching the switch shaft, wherein the switch shaft is moving toward a fully latched position after having reached the end of the opening stroke and starting to rebound, in accordance with an example embodiment of the disclosed concept.
Figure 5D:
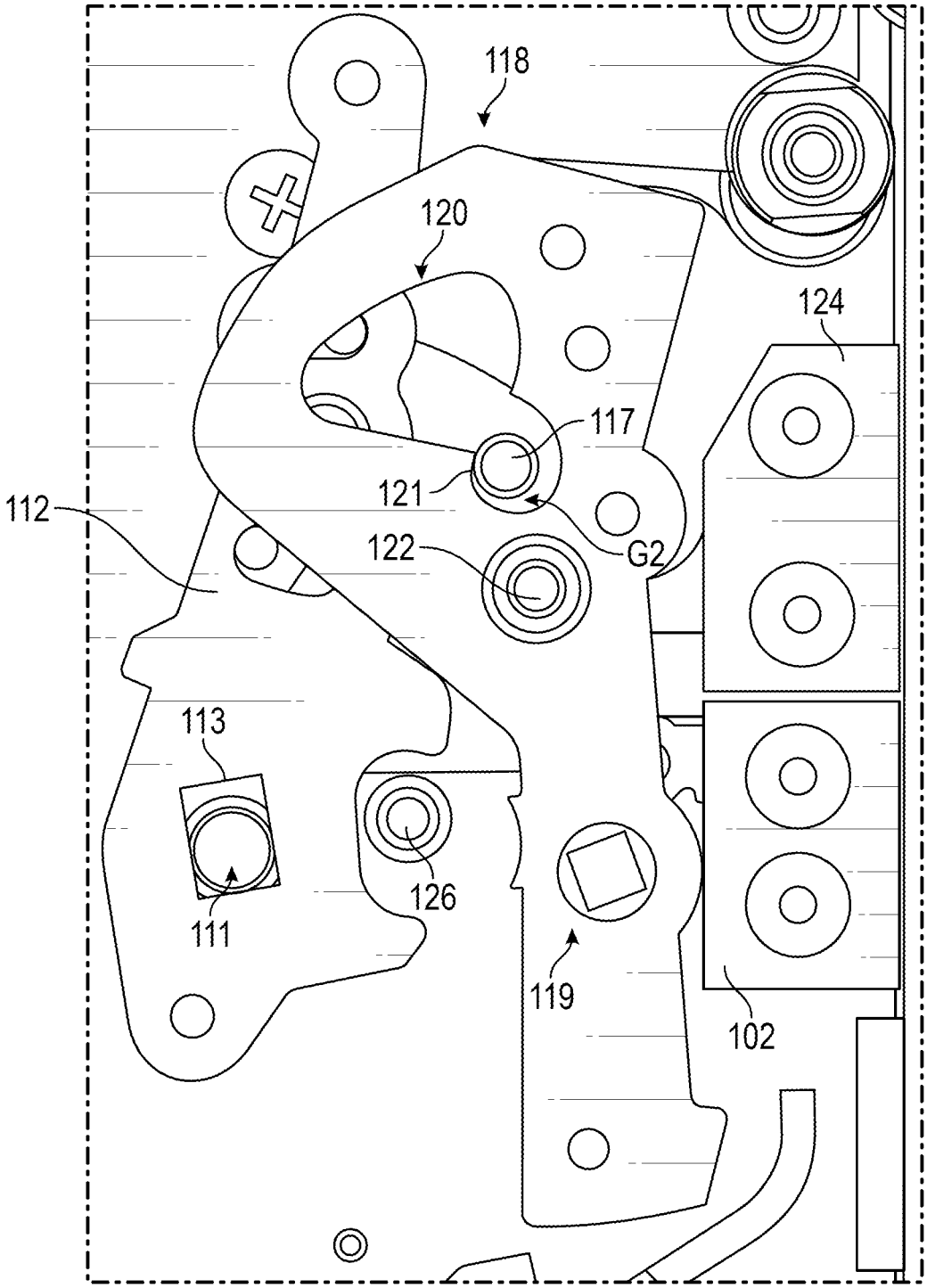
FIG. 5D shows the same sectional view of the latching assembly shown in FIG. 5B during the same intermediary stage of latching shown in FIG. 5C.
Figure 5E:
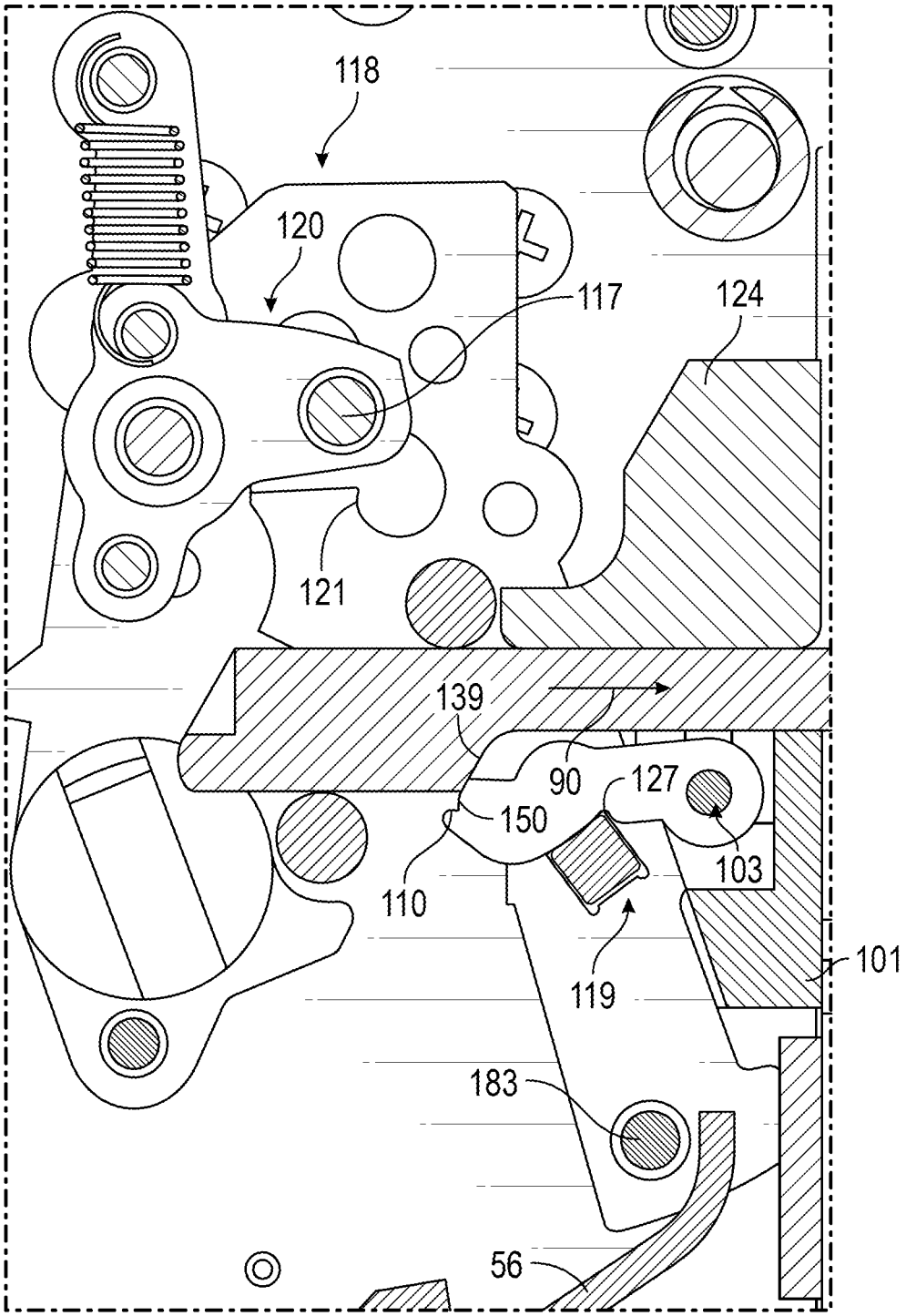
FIG. 5E shows the same sectional view of the latching assembly shown in FIG. 5C after the switch shaft has reached a fully latched position, in accordance with an example embodiment of the disclosed concept.
Figure 5F:
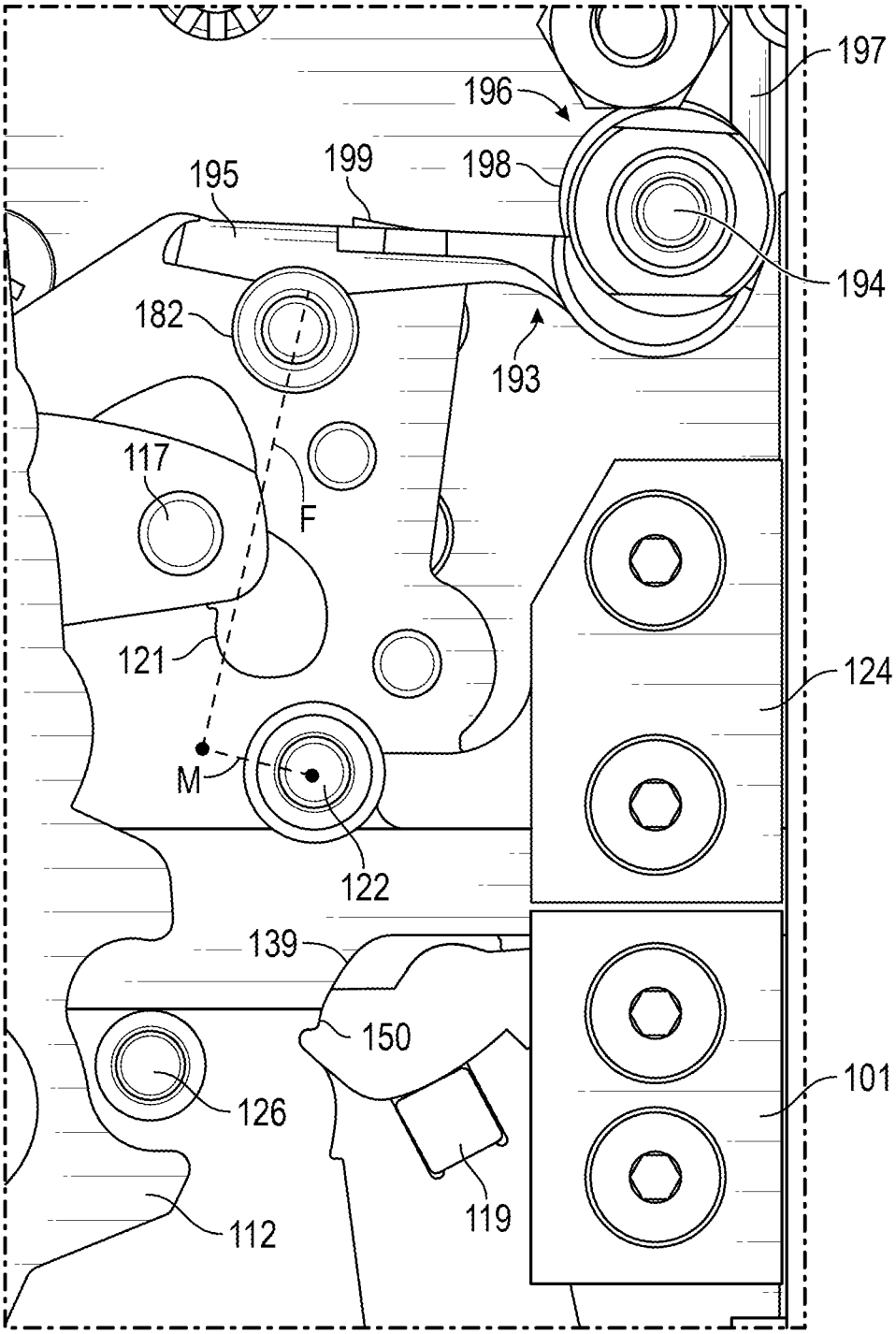
FIG. 5F shows an enlarged portion of the same sectional view of the latching assembly shown in FIG. 5D but with some hidden components from FIG. 5D shown and other components from FIG. 5D hidden, wherein the switch shaft and hammer are in a partially latched position instead of the fully latched position, and shows how a torsion spring and cam assembly create a moment arm that can propel the hammer to rotate to the fully latched position if no other forces are acting on the hammer, in accordance with an example embodiment of the disclosed concept.

Referring now to FIGS. 5A-5F in addition to FIGS. 2A and 4, it should be noted that FIGS. 5A-5B depict the disposition of the switch shaft 136 and latch assembly 100 in an initial opening state right after an opening stroke has been initiated. FIGS. 5C-5D depict an initial stage of latching, wherein the switch shaft is moving toward a fully latched position after having reached the end of the opening stroke and starting to rebound. FIG. 5E depicts a fully latched state of the latching assembly 100 and switch shaft 136, and FIG. 5F depicts a partially latched state of the latching assembly 100 and switch shaft 136. As shown in FIGS. 5A-5F, the latching assembly 100 additionally comprises a reset shaft 111, a reset lever 112, a claw spring 115, a claw 116, a claw pin 117, and a hammer 118. The reset shaft 111 is operatively coupled to the reset lever 112 via engagement between the reset shaft 111 and a shaft engagement opening 113 formed in reset lever 112 (as shown in FIGS. 5B and 5D). The reset lever 112 is additionally operatively coupled to the claw 116 via the claw spring 115, and the claw 116 is additionally operatively coupled to the hammer 118 via the claw pin 117.

In addition, and as best shown in FIG. 4, the hammer 118 comprises a square pin 119, two planar sides 180, and a plurality of rounded hammer pins, the rounded hammer pins including a number of interior hammer pins 181, a cam engagement pin 182 and a paddle engagement pin 183. The two planar sides 180 are formed with openings structured to receive the ends of the square pin 119 and of the rounded hammer pins such that the square pin 119 and rounded hammer pins are able to couple the two planar sides 180 to one another. In addition and as detailed further later herein, the square pin 119 also directly drives the driven latch 102 during a latching operation, and the cam engagement and paddle engagement pins 182, 183 are used to unlatch and re-close the moving assembly 38 after latching (detailed with respect to FIGS. 6A-6D).

It will be noted that the switch shaft 136 is configured to move only linearly (i.e. only in the opening and closing directions 80 and 90 denoted in FIG. 2A), and in viewing FIGS. 5A-5E, it can be seen that the latch block 101, driven latch 102, and hammer 118 are structured such that the distal end of the switch shaft 136 is always disposed between the hammer square pin 119 and the interior hammer pins 181. In addition, the two hammer planar sides 180 are structured to be disposed parallel to one another and to the path of travel of the switch shaft 136 such that the interior and exterior flat surfaces 184, 185 of the planar sides 180 are parallel to any lines coincidental with the path that the switch shaft 132 travels in the opening direction 80 or closing direction 90. For each planar side 180, the interior flat surface 184 of the planar side 180 is that surface which faces toward the other planar side 180. That is, the interior flat surface 184 of each planar side 180 faces the interior flat surface 184 of the other planar side 180. Accordingly, for each planar side 180, the exterior flat surface 185 of that planar side 180 is the flat surface disposed opposite the interior flat surface 184.

Each of the two planar sides 180 of the hammer 118 further comprises a proximal edge 186 and a distal edge 187, such that, for a given planar side 180, each proximal edge 186 and each distal edge 187 is adjacent to and extends between the interior flat surface 184 and the exterior flat surface 185 of the planar side 180. Only the distal edges 187 are visible in FIG. 4, and both a proximal edge 186 and a distal edge 187 are labeled in FIG. 5C. Each proximal edge 186 comprises a protrusion 188 (shown labeled in FIG. 5C) such that the protrusion 188 is convex relative to the neighboring portion of the proximal edge 186, and each distal edge 187 comprises a divot 189 (numbered in FIGS. 2A, 4, and 5C) such that the divot 189 is concave relative to the neighboring portion of the distal edge 187.

As shown in FIG. 5A, each protrusion 188 comprises a center of curvature point 191 and each divot 189 comprises a center of curvature point 192 (the divot 189 is not numbered in FIG. 5A). For each hammer planar side 180, the protrusion 188 and the divot 189 are adjacent to the square pin 119 extending through the planar side 180 such that a line (shown unnumbered in FIG. 5A) extending from the protrusion center of curvature point 191 to the divot center of curvature point 192 must pass through the square pin 119. As previously stated, the latch block 101 comprises two depressions 106 on its distal side, and these depressions 106 are structured to receive the hammer protrusions 188 when the latching assembly 100 is disposed in a fully latched state, as detailed further herein with respect to FIG. 5E.

Prior to providing a detailed description of the steps involved in a latching operation, specific features of the switch shaft 136 and driven latch 102 that facilitate latching should be noted. It can be observed from FIG. 5A that the switch shaft 136 is structured to comprise at least two portions with differing widths, a first portion 137 of a first width and a second portion 138 of a second width greater than the first width, and that a shelf 139 (also numbered in FIGS. 5C and 5E) is formed by the meeting of the first portion 137 with the second portion 138, with the shelf 139 extending between a lateral surface 140 of the first portion 137 and a lateral surface 141 of the second portion 138. Latch 102 is designed to include two steps, a closing step 109 (numbered in FIG. 2A and FIG. 5A) and a latching step 110 (not numbered in FIG. 2A but numbered in FIGS. 5A, 5C, and 5E), the closing step 109 and latching step 110 being joined together by a riser 150 (numbered in FIGS. 5A, 5C, 5E, and 5F). The closing step 109, latching step 110, and riser 150 are formed in the medial surface 107 and structured to engage either the shelf 139 or the lateral surface 141 of the switch shaft 136 at different times, depending on whether the moving assembly 38 is in a closed state, a fully latched and open state, or a partially latched and open state. As shown in FIG. 2A, the driven latch 102 is structured such that its closing step 109 engages the lateral surface 141 of the switch shaft 136 when the moving assembly 38 is in a closed state, and as detailed further later herein with respect to FIGS. 5E-5F, the driven latch 102 is configured to rotate during an opening stroke such that its riser 150 can engage the shelf 139 in order to latch the switch shaft 136 in either a fully latched state or a partially latched state when the moving assembly 38 rebounds after the conclusion of an opening stroke.

Details of how the components of the latching assembly 100 function to latch the moving assembly 38 after an opening stroke are now provided. Referring first to FIGS. 5A and 5B, these figures depict an initial opening state in which the switch shaft 136 is moving in the opening direction 80 toward a fully open position, due to either the Thomson coil actuator 40 or the slow opening solenoid assembly 50 initiating an opening stroke of the moving assembly 38 (FIG. 2A). The components of the circuit interrupter 1 are arranged such that, when an opening stroke is initiated to propel the switch shaft 136 to travel in the opening direction 80, the contact spring 60 (FIG. 2A) exerts a force against the switch shaft 136 as the opening stroke commences, which in turn causes the switch shaft 136 to push against the closing step 109 of the driven latch 102. FIGS. 5A and 5B show that the switch shaft 136 loses contact with the closing step 109 shortly after pushing against the closing step 109 and commencing travel in the opening direction 80 upon initiation of an opening stroke. The push of the switch shaft 136 against the driven latch closing step 109 causes the lateral surface 108 of the driven latch 102 to exert a force against the square pin 119 of the hammer 118, thereby initiating an opening rotation sequence of the hammer 118. Opening rotation of the hammer 118 is rotation that enables the latching assembly 100 to latch the switch shaft 136 in an open state, with said opening rotation being that which moves the cam engagement pin 183 of the hammer 118 away from a mounting block 124 (the mounting block 124 being described later herein), said opening rotation being counter clockwise relative to the view shown in FIGS. 5A-5F. After the switch shaft shelf 139 disengages from (i.e. loses contact with) the driven latch closing step 109, the movement of the switch shaft 136 in the opening direction 80 results in the distal end of the switch shaft 136 pushing against the reset shaft 111.

The impact between the switch shaft 136 and the reset shaft 111 causes the reset shaft 111 to initiate a series of actions by the components of the latching assembly 100 that further propel the opening rotation of the hammer 118. Specifically, the impact between the switch shaft 136 and the reset shaft 111 causes the reset lever 112 to pivot due to the operative coupling between the reset shaft 111 and the reset lever 112. The pivoting of the reset lever 112 consequently causes the claw 116 to pivot, due to the operative coupling between the reset lever 112 and the claw 116. The pivoting of the claw 116 consequently exerts rotational force on the hammer 118 (as previously stated, the rotation of the hammer is counter clockwise, relative to the view shown in FIGS. 5A-5F), due to the operative coupling between the claw 116 and the hammer 118. The operative coupling between the claw 116 and the hammer 118 is facilitated by engagement between the claw pin 117 and a claw engagement groove 121 of a claw pin opening 120 formed in the hammer 118, the claw pin opening 120 being structured to receive the claw pin 117 (claw pin opening 120 and claw engagement groove 121 are numbered in FIGS. 5B, 5D, and 5E). The hammer rotates about a fixed axis formed by a rotation pin 122 (numbered in FIGS. 5A-5D) that is fixedly coupled to the actuator housing 15 and inserted through rotation pin openings 123 (numbered in FIG. 4) formed in the planar sides 180 of the hammer 118.

As previously stated, the circuit interrupter 1 can further include a mounting block 124, as well as a guiding pin 126, in order to ensure that the switch shaft 136 will only move linearly (i.e. in either the opening direction 80 or the closing direction 90) by minimizing the ability of the switch shaft 136 to move laterally (i.e. in any direction disposed perpendicularly to the opening direction 80 or the closing direction 90). The mounting block 124 is fixedly coupled to the actuator housing 15 and can be coupled using any suitable method including, for example and without limitation, securing the mounting block 124 to the housing 15 with a number of pins. The mounting block 124 is positioned adjacent to the latch block 101, so as to be positioned laterally relative to the switch shaft 136 on a side of the switch shaft 136 disposed opposite the latch block 101. The guiding pin 126 is also fixedly coupled to the actuator housing 15, and it will be appreciated that the guiding pin 126 ensures linear travel of the switch shaft 136 by being positioned on a side of the switch shaft 136 disposed opposite the rotation pin 122 and opposite the mounting block 124. The inclusion of the mounting block 124 and the guiding pin 126 also ensures that the driven latch 102 and hammer 118 engage as required for proper operation of the latching assembly 100.

Referring once more to FIG. 2A, the divots 189 formed in the distal edges 187 of the hammer planar sides 180 are structured to engage the guiding pin 126 when the latching assembly 100 is in the closed state, and it will be appreciated that the hammer 118 cannot rotate further in a clockwise direction (relative to the view shown in FIG. 2A) past the point where the divots 189 of the hammer engage the guiding pin 126. The latch block 101, driven latch 102, and hammer 118 are all proportioned and structured such that the square pin 119 of hammer 118 always engages the lateral side 108 (FIGS. 5A and 5C) of the driven latch 102, and accordingly, when the hammer 118 rotates counterclockwise (relative to the view shown in FIGS. 5A-5F) during an opening stroke as described above, the resulting motion of the square pin 119 causes the driven latch 102 to rotate as well.

Still referring to FIGS. 5A and 5B, it will be appreciated that, after the distal end of switch shaft 136 first pushes against the reset shaft 111 while moving in the opening direction 80, the switch shaft 136 continues to move a short distance in the opening direction 80 as the subsequent pivoting and rotations of the reset lever 112, claw 116, hammer 118, and driven latch 102 take place. The switch shaft 136 moves in the opening direction 80 until the impact washer 46 (FIG. 2A) impacts the stop plate 48 (FIG. 2A). The impact between the impact washer 46 and the stop plate 48 initiates a rebound of the switch shaft 136 wherein the switch shaft ceases travel in the opening direction 80 and then starts to travel in the closing direction 90. In comparing FIGS. 5C and 5D to FIGS. 5A and 5B, respectively, it can be seen that FIGS. 5C and 5D depict the previously described opening rotation of the hammer 118 and the driven latch 102 relative to FIGS. 5A and 5B.

Referring to FIGS. 5C and 5D, the latching assembly 100 is structured to ensure that, by the time the switch shaft 136 starts to rebound, the hammer 118 will have rotated such that its square pin 119 will have moved closer toward both the latch block 101 and a notch 127 formed in the lateral surface 108 of the driven latch 102. It is noted that the square pin 119 remains engaged with the lateral surface 108 of the driven latch 102 at all times, i.e. from the closed state through the opening stroke and through rebounding of the moving assembly 38. It should be noted that the lateral surface 108 of the driven latch 102 comprises a curved portion that extends between the latching step 110 and the notch 127. This curved portion of the lateral surface 108 comprises an apex 142, a distal portion 143, and a proximal portion 144 (FIG. 5C is the only figure in which the apex 142, distal portion 143, and proximal portion 144 are shown numbered). The distal portion 143 extends between the latching step 110 and the apex 142, and the proximal portion 144 extends between the apex 142 and the notch 127. In comparing FIG. 5C to FIG. 5A, it will be appreciated that the opening rotation of the hammer 118 causes the square pin 119 to move from engagement with the lateral surface distal portion 143 (FIG. 5A) to engagement with the lateral surface proximal portion 144 (FIG. 5C). The state depicted in FIGS. 5C and 5D depicts an intermediary stage in the process of fully latching the switch shaft (the fully latched state being shown in FIG. 5E). This intermediary state that the latching assembly 100 assumes during the full latching process can be identified by both the engagement of the hammer square pin 119 with the lateral surface proximal portion 144, and the gap G1 between the switch shaft shelf 139 and the riser 150 of the driven latch 102, as shown in FIG. 5C.

Referring now to FIG. 5E, a fully latched and open state is shown. The components of the latching assembly 100 are structured and configured to generate momentum that carries the switch shaft 136 and the latching assembly 100 into the fully latched configuration once the latching assembly 100 reaches the intermediary state shown in FIGS. 5C and 5D. In particular and with reference to FIG. 5C, once the hammer 118 has rotated far enough such that the square pin 119 engages the proximal portion 144 of the driven latch lateral surface 108 (as shown in FIG. 5C), and as long as there is a gap between the switch shaft shelf 139 and the driven latch riser 150 (i.e. gap G1 shown in FIG. 5C), a moment arm produced by force exerted on the hammer 118 by a torsion spring and cam assembly (the torsion spring and cam assembly being numbered in FIG. 5F and detailed further with respect thereto) will propel the hammer 118 to continue rotating until the square pin 119 engages the notch 127 of the driven latch 102, as shown in FIG. 5E. Referring briefly again to FIG. 5D in addition to FIG. 5C, it should be noted that once the hammer 118 has rotated far enough for the square pin 119 to engage the proximal portion 144 of the driven latch lateral surface 108, (FIG. 5C), the claw pin 117 will disengage from the claw engagement groove 121 of the hammer 118 (in FIG. 5D, see the gap G2 that forms between the claw pin 117 and the claw engagement groove 121) while still remaining within the claw pin opening 120.

Referring still to FIG. 5E, it is noted that in the fully latched state, the two depressions 106 (not visible in FIG. 5E but shown and numbered in FIG. 5C) formed on the distal side of the latch block 101 receive the hammer protrusions 188, which can be observed by comparing the position of the protrusion 188 shown in FIG. 5C to its position in FIG. 5E (the protrusion 188 shown in FIG. 5C is not visible in FIG. 5E). The engagement between the hammer square pin 119 and the driven latch notch 127, and the engagement between the driven latch riser 150 and the switch shaft shelf 139, prevent the switch shaft 136 from moving further in the closing direction 90 and thus ensure that the separable contacts 8 will remain physically separated and electrically isolated until an unlatching and re-closing operation is purposely commenced, as described hereinafter with respect to FIGS. 6A-6D.

It should be noted that the latching assembly 100 is designed to latch the switch shaft 136 in the fully latched state whether an opening stroke is a fast stroke initiated by the Thomson coil actuator 40 or a normal stroke initiated by the slow open solenoid assembly 50. During a normal speed opening stroke, the switch shaft 136 travels at a relatively slow speed and the rebound time is relatively longer, and during a fast opening stroke, the switch shaft 136 travels at a relatively fast speed and the rebound time is relatively short. The slower travel speed of the switch shaft 136 during a normal opening stroke results in the switch shaft 136 exerting less force on the components of the latching assembly 100 such that the hammer 118 rotates more slowly during a normal opening stroke. However, the slower travel speed of the switch shaft 136 during the opening stroke and during the rebound provides sufficient time for the hammer 118 to rotate sufficiently in order for the latching assembly 100 to fully latch the switch shaft 136 as shown in FIG. 5E. The faster travel speed of the switch shaft 136 during a fast opening stroke results in the switch shaft 136 rebounding faster, leaving less time for the hammer 118 to rotate sufficiently in order to fully latch the switch shaft 136 as shown in FIG. 5E. However, because the faster travel speed of the switch shaft 136 during a fast opening stroke also results in the switch shaft 136 exerting greater force on the components of the latching assembly 100, the hammer 118 rotates more quickly such that the latching assembly is able to fully latch the switch shaft 136 during a fast opening stroke.

Referring now to FIG. 5F, a partial latching state of the latching assembly 100 and the switch shaft 136 is shown, in accordance with an exemplary embodiment. It should be noted that, although the latching assembly 100 is structured to fully latch the switch shaft 136 after both normal speed and fast opening strokes, variations that arise in the parts manufacturing and assembly processes can cause variations in the structure and configuration of the latching assembly 100. Even slight variations in the dimensions and alignment of the parts can prevent the hammer 118 from rotating sufficiently to achieve full latching of the switch shaft 136 on a rebound. However, the latching assembly 100 is advantageously structured to be able latch the switch shaft 136 in the partial latching state shown in FIG. 5F in the event that the hammer 118 is unable to rotate fast enough in order to latch the switch shaft 136 in a full latching state. Even though failure to achieve full latching of the switch shaft is the worst case scenario, it should be noted that partial latching is still considered a successful latching operation, as partial latching effectively prevents unintended re-closing of the separable contacts. It should also be noted that engagement between the switch shaft shelf 136 and the driven latch riser 150 is common to both the fully latched state and the partially latched state.

The determinative factor in whether the latching assembly 100 latches the switch shaft 136 in the fully latched state (FIG. 5E) or in the partially latched state (FIG. 5F) is whether or not a gap (i.e. gap G1 in FIG. 5C) is present between the switch shaft shelf 139 and the driven latch riser 150 by the time the hammer 118 has rotated sufficiently for the square pin 119 to engage the lateral surface proximate portion 144. With reference to FIG. 5F, it is noted that the partial latching state shown in FIG. 5F results from the switch shaft shelf 139 engaging the riser 150 of the driven latch 102 when the hammer square pin 119 is engaged with the lateral surface proximal portion 144 of the driven latch but before the square pin 119 has engaged the notch 127 of the driven latch 102. Stated alternatively, the operating conditions that result in a partially latched state prevent there being a gap between the switch shaft shelf 139 and the driven latch riser 150 (i.e. the gap G1 in FIG. 5C) by the time the hammer 118 rotates sufficiently for the square pin 119 to engage the lateral surface proximate portion 144, which prevents the hammer 118 from being able to rotate further in order to fully latch the switch shaft 136.

Still referring to FIG. 5F, some of the forces that contribute to a latching operation are now detailed. The circuit interrupter 1 further comprises a hammer cam assembly 193 and a torsion spring 196, with the cam assembly 193 comprising a camshaft 194 and a follower 195. The torsion spring comprises a first end 197, a central portion 198, and a second end 199 disposed opposite the first end 197. The spring central portion 198 is coupled to the camshaft 194 and functions as the cam of the cam assembly 193. It is noted that the cam assembly 193 and torsion spring 196 are only visible in some of FIGS. 5A-5E, depending on the cutting plane used to generate each figure. During the latching process, a force is exerted by the torsion spring 196 through the cam follower 195 onto the cam engagement pin 182 of the hammer 118. As previously noted, the hammer 118 is structured to rotate about a fixed axis formed by the rotation pin 122 that is fixedly coupled to the actuator housing 15. The force exerted by the torsion spring 196 onto the cam engagement pin 182 during latching produces a force line of action F extending from the cam follower 195 through cam engagement pin 182 that in turn creates a moment arm M, with the moment arm M extending from the force line of action F to the rotation pin 122. It is noted that the moment arm M is positive with respect to the view shown in FIG. 5F.

It should be noted that, in FIG. 5F, which depicts partial latching of the switch shaft 136, it is the engagement between the switch shaft shelf 139 and the driven latch riser 150 that prevents the moment created by the force F and moment arm M from rotating the hammer 118 into the fully latched position. In addition, it is noted that, when the components of the latching assembly 100 move quickly enough to enable full latching of the switch shaft 136 rather than partial latching, the force F and moment arm M are what propel the hammer 118 into the fully latched state shown in FIG. 5E from the state shown in FIG. 5C.

Figure 6B:
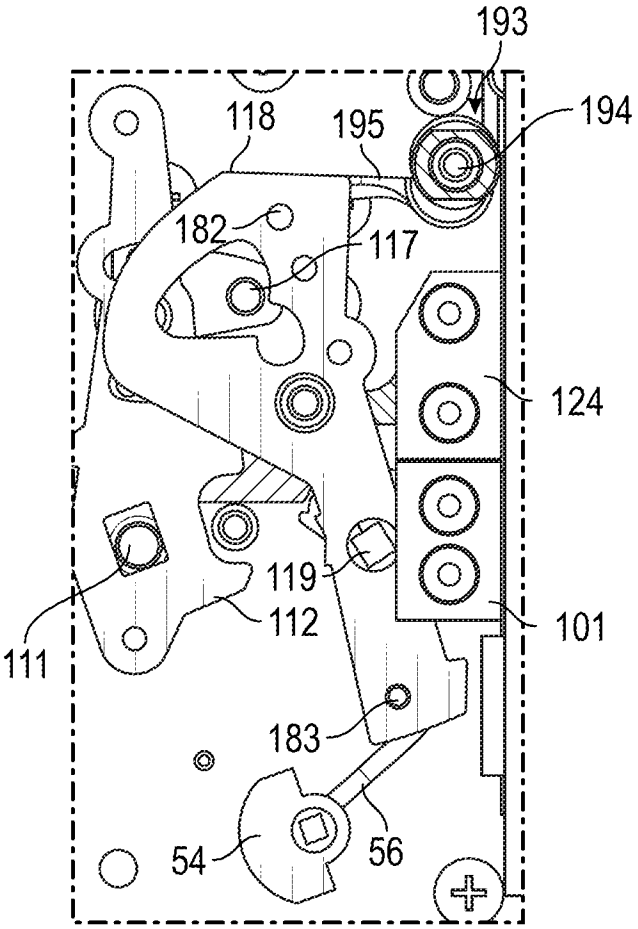
FIG. 6B is an elevation view of the latching assembly during the same initial re-closing stage of the opening stroke shown in FIG. 6A, taken along the plane 4S2-4S2 denoted in FIG. 4.
Figure 6A:
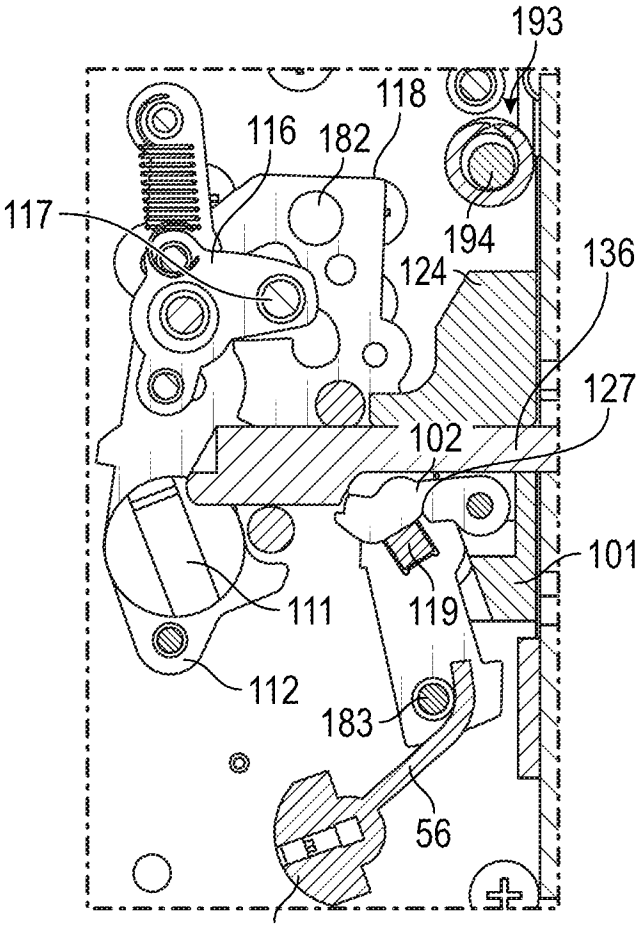
FIG. 6A shows the same sectional view (taken along the plane 4S1-4S1 denoted in FIG. 4) of the latching assembly shown in FIG. 5E, at an initial stage of re-closing the movable conductor assembly of the circuit interrupter shown in FIG. 2A, in accordance with an example embodiment of the disclosed concept.

Referring now to FIGS. 6A-6D, as well as FIGS. 2A-3, the unlatching process that takes place when re-closing of the separable contacts 8 is desired will now be detailed. Referring first to FIGS. 6A and 6B, when the latching assembly 100 and switch shaft 136 are in the fully latched state, the unlatching process commences when the slow open solenoid 52 (FIGS. 2A-2B) and closing solenoid 53 (FIGS. 2B-3) are activated. First, the slow open solenoid 52 is supplied with a reduced voltage, the voltage being reduced as compared to the voltage used to actuate a normal speed opening stroke. When the reduced voltage is supplied to slow open solenoid 52, the magnetic force exerted by the slow open solenoid 52 on the switch shaft 136 actuates the switch shaft 136 to move slowly in the opening directly 80, thereby removing the force exerted by the switch shaft 136 and the driven latch 102 on one another in the fully latched state.

Next, the closing solenoid 53 is supplied with voltage in order to actuate the solenoid paddle 54. When voltage is supplied to the closing solenoid 53, the closing solenoid 53 exerts a magnetic force on the solenoid link 57, which in turn causes the paddle link 58 to rotate the solenoid paddle 54. The rotation of the solenoid paddle 54 rotates the paddle arm 56 from its deactivated position (the deactivated position of the solenoid paddle 54 and arm 56 being shown in FIGS. 5A-5E) into engagement with the paddle engagement pin 183 of the hammer 118 in order to remove the latching force exerted by the hammer square pin 119 on the driven latch 102.

The unlatching process is similar when the latching assembly 100 and switch shaft 136 are in the partially latched state (FIG. 5F), but with an additional step at the beginning of the process. If the latching assembly 100 and switch shaft 136 are in the partially latched state when the unlatching process begins, the activation of the slow open solenoid 52 and removal of the latching force exerted by the switch shaft 136 and the driven latch 102 on one another causes the hammer 118 to first rotate to the same position it assumes in the fully latched state (i.e. causes the hammer 118 to rotate counterclockwise relative to the view shown in FIGS. 6A-6D, so that the hammer 118 reaches the position shown in FIG. 5E), due to the positive moment arm M previously described with respect to FIG. 5F. Then, when voltage is supplied to the closing solenoid 53, the same actions that occur when the process starts from the fully latched state occur: the closing solenoid 53 exerts a magnetic force on the solenoid link 57, thus causing the paddle link 58 to rotate the solenoid paddle 54, which results in the previously described rotation of the paddle arm 56 from its deactivated position into engagement with the paddle engagement pin 183 of the hammer 118 in order to remove the latching force exerted by the hammer square pin 119 on the driven latch 102.

Figure 6D:
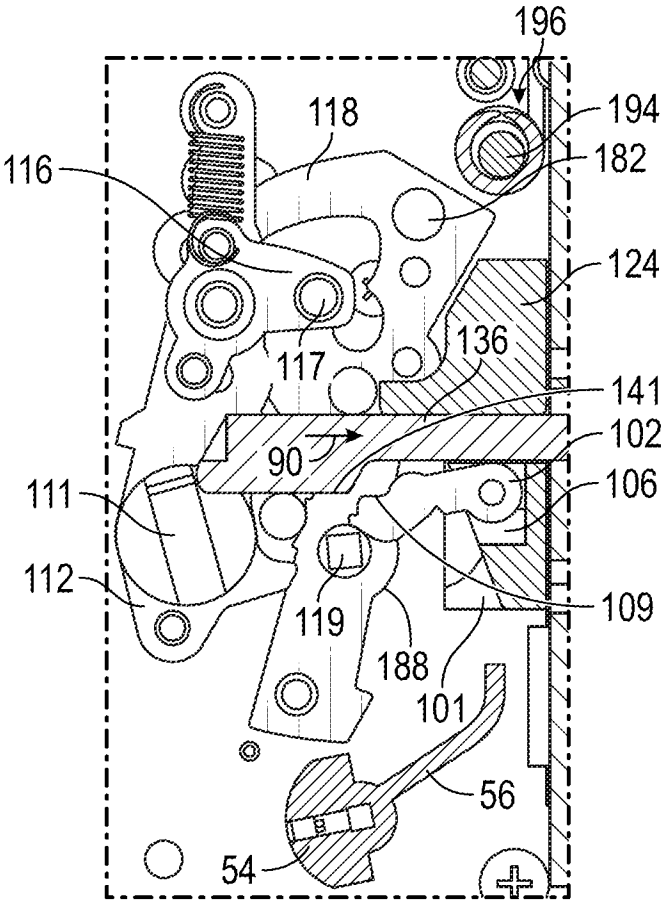
FIG. 6D shows the same sectional view of the latching assembly shown in FIG. 6A at a final stage of re-closing the movable conductor assembly that follows the stage shown in FIG. 6C, as the switch shaft moves into the fully closed position, in accordance with an example embodiment of the disclosed concept.
Figure 6C:
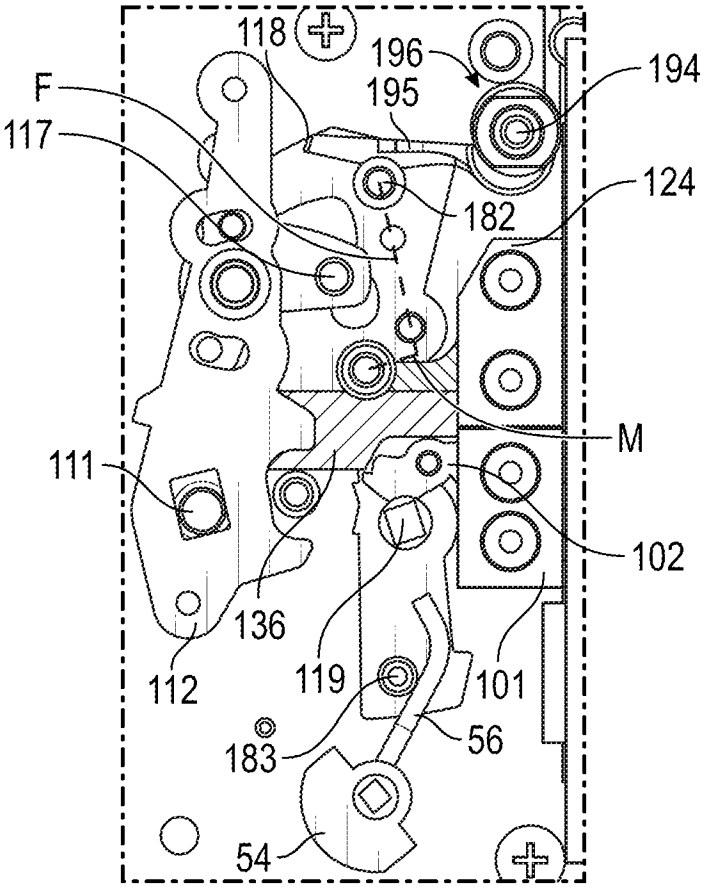
FIG. 6C is an enlarged sectional view of the latching assembly shown in FIG. 2A, taken along the viewing plane 6C-6C denoted in FIG. 4, showing an intermediate stage of re-closing the movable conductor assembly that follows the stage shown in FIGS. 6A and 6B, and also showing how the torsion spring and cam assembly create a moment arm that drives the hammer to rotate to a fully closed position, in accordance with an example embodiment of the disclosed concept.

Still referring to FIGS. 6A and 6B, and referring to FIGS. 6C and 6D in conjunction, when the solenoid arm 56 rotates the hammer 118 such that the hammer square pin 119 becomes disengaged from the notch 127 of the driven latch 102, the rotation also causes the cam engagement pin 182 of the hammer 118 to travel closer toward the mounting block 124 (i.e. in a clockwise direction, with respect to the view shown in FIGS. 6A-6D), as can be seen by comparing FIG. 6C to FIGS. 6A and 6B. Once the solenoid paddle arm 56 has rotated the hammer 118 to the position shown in FIG. 6C, the force F (depicted in FIG. 6C) exerted by the torsion spring 196 on the cam engagement pin 182 of the hammer 118 via the camshaft 194 and follower 195 creates a moment arm M (depicted in FIG. 6C) that drives the hammer 118 to rotate toward the mounting block 124 (i.e. in a clockwise direction, with respect to the view shown in FIGS. 6A-6D) and into the closed state. When comparing FIG. 6D to FIG. 6C, it can be seen that the cam engagement pin 182 is closer to the mounting block 124 in FIG. 6D than in FIG. 6C.

Referring to FIG. 6D, once the hammer cam assembly 193 has rotated the hammer 118 to its closed state, the closing solenoid 53 is deactivated. The removal of the magnetic force resulting from deactivation of the closing solenoid 53 enables the solenoid link return spring 59 to bias the solenoid paddle 54 and paddle arm 56 back to the deactivated position (the deactivated position shown in FIG. 6D is the same as that shown in FIGS. 5A-5E) and disengage from the paddle engagement pin 183 of the hammer 118. The slow open solenoid 52 is also deactivated once the closing solenoid 53 is deactivated. As the hammer 118 rotates into its closed state, the rotation and pivoting of the reset shaft 111, reset lever 112, and claw 116 that occurred during the stages of the latching process occur in reverse, i.e. the rotation of the hammer 118 causes the claw 116 to pivot, the pivoting of the claw 116 consequently causes the reset lever 112 to pivot, and the pivoting of the reset lever 112 consequently causes the reset shaft 111 to rotate.

It will be appreciated that the switch shaft 136 and the driven latch 102 cease to be engaged with one another after the initial unlatching that occurs with the activation of the slow open solenoid 52 (as depicted in FIG. 6A). The disengagement of the switch shaft 136 from the driven latch 102 after the initial unlatching step, as well as the rotation and pivoting of the hammer 118, claw 116, reset lever 112, and reset shaft 111, results in the reset lever 111 and the switch shaft 136 coming into contact with one another such that the reset shaft 111 rotates and pushes against the distal end of the reset shaft 136, causing the reset shaft 136 to travel in the closing direction 90. As previously stated, the circuit interrupter 1 includes a contact spring 60, spring fork 62, and transfer shaft 64 structured to bias the moving assembly 38 into the closed state when the moving assembly 38 is not latched. Thus, the lack of engagement between the switch shaft shelf 139 and the driven latch 102, as well as the push of the reset lever 111 against the distal end of the switch shaft 136, results in the switch shaft 136 moving in the closing direction 90 as depicted in FIG. 6D. Continuing to refer to FIG. 6D, the latching assembly 100 is structured such that, by the time the hammer 118 has rotated into the closed position, the driven latch 102 is disposed so that its closing step 109 can be engaged by the switch shaft lateral surface 141 as the switch shaft 136 continues moving in the closing direction 90. It will be appreciated that the switch shaft 136 stops moving in the closing direction 90 once its lateral surface 141 has engaged the driven latch closing step 109 (as shown in FIG. 2A), since the moving assembly 38 is in the closed state at that point.

Figure 7:
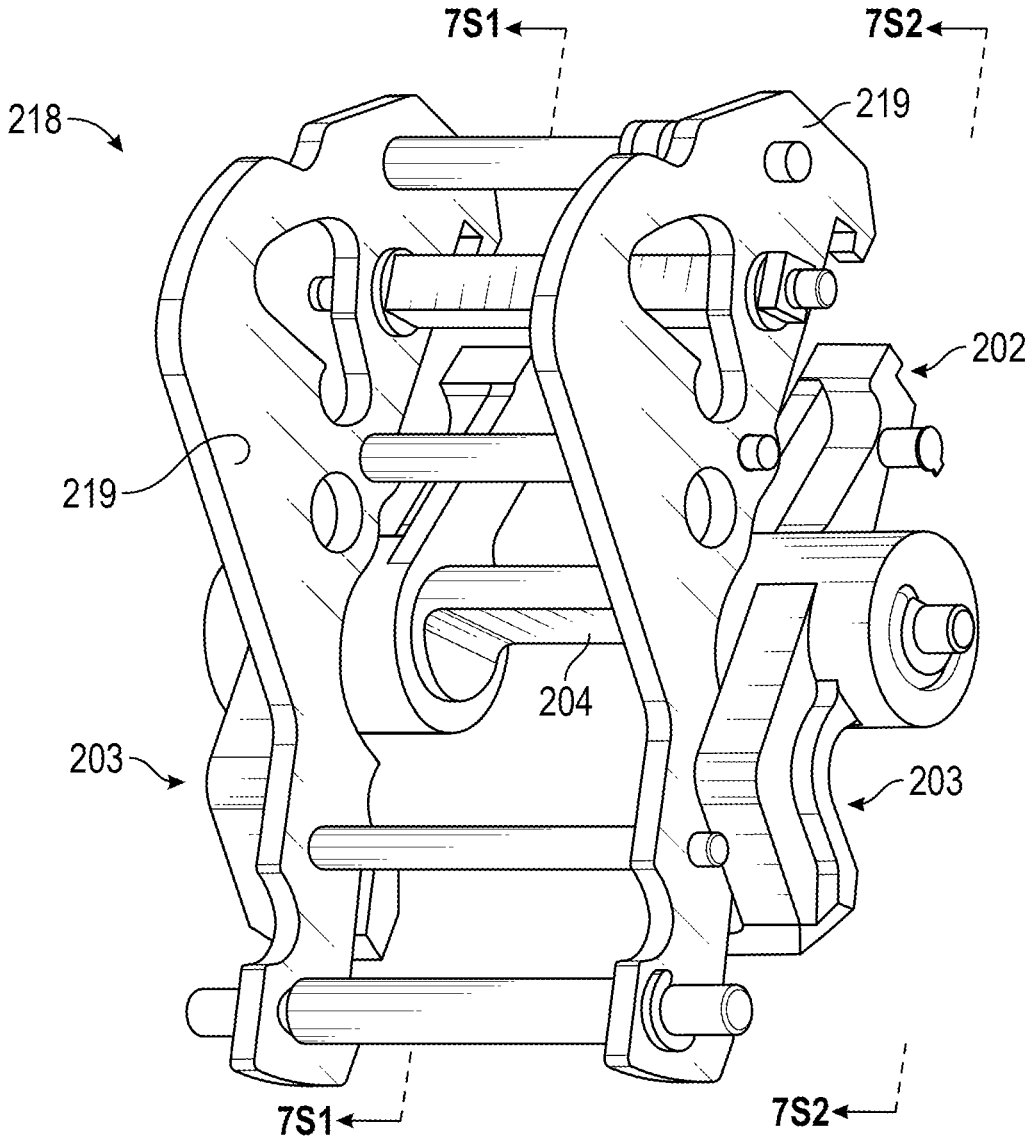
FIG. 7 is an enlarged isometric view of a latch block, a d-shaft style latch, and a hammer representative of d-shaft style latching arrangements used in known latching assemblies for circuit interrupters.

Referring now to FIGS. 7, 8A-8B, and 9A-9B, a d-shaft style latching assembly 200 and its components are shown as a reference against which to highlight the advantageous features of the latch 102 and latching assembly 100 shown in FIGS. 2A-6D. FIG. 7 shows a latch block 201 and a d-shaft style latch 202 representative of d-shaft style latches used in known latching assemblies for circuit interrupters, and FIGS. 8A-8B and 9A-9B show a latching assembly 200 that includes the latch block 201 and d-shaft latch 202 shown in FIG. 7. As shown in FIG. 7, D-shaft latch 202 comprises a plurality of legs 203 and a d-shaft 204. The legs 203 serve to restrict movement of the d-shaft latch 202 in a lateral direction (i.e. a direction coincidental with the longitudinal axis of the d-shaft 204), by reducing the amount of free space between the planar sides 219 of the hammer 218 and the sidewalls of the circuit interrupter in which the latching assembly 200 is mounted. The hammer planar sides 219 are coupled together by a coupling pin 220, and it should be noted that the ends of the coupling pin 220 extend laterally from the hammer planar sides 219.

As detailed further hereinafter, when the components of latching assembly 200 do not move precisely as they need to during an opening stroke, there is an increased likelihood that the legs 203 of d-shaft latch 202 will be subjected to undesired impact and experience deformation as a result. In contrast, in latching assembly 100, coupling the driven latch 102 within the well 105 formed in latch block 101 prevents the driven latch 102 from moving laterally (i.e. in a direction coincidental with the longitudinal axis of pin 103), and thus renders it unnecessary to include in the driven latch 102 an additional component comparable to the legs 203. The relatively streamlined design of driven latch 102 as compared to d-shaft latch 202, particularly the elimination of the legs 203, significantly decreases the likelihood of damage to the latch 102 and other components of the latching assembly 100, and thus represents an improvement over d-shaft style latches and latching assemblies.

Still referring to FIGS. 7-9B, it can be seen that latching assembly 200 comprises several components similar to latching assembly 100, with certain details of the components differing due to the structural differences between the d-shaft latch 202 and driven latch 102. In addition to the latch block 201 and d-shaft latch 202, latching assembly 200 comprises a reset shaft 211, a reset lever 212, a claw 216, and a hammer 218. Similarly to the corresponding components of latching assembly 100, the reset shaft 211 is operatively coupled to the reset lever 212, the reset lever 212 is additionally operatively coupled to the claw 216 via a claw spring 215, and the claw 216 is additionally operatively coupled to the hammer 218 via a claw pin 217. In addition, a circuit interrupter that uses latching assembly 200 would include a switch shaft 236 similar to and in place of the switch shaft 136, with the distal end of the switch shaft 236 including design features that render it suitable to be latched by the d-shaft latch 202.

The components of latching assembly 200 are structured to function similarly to the corresponding components in latching assembly 100. That is, when the latching assembly 200 operates as intended, the distal end of the switch shaft 236 pushes against the reset shaft 211 when switch shaft 236 moves in the opening direction 80 during an opening stroke. The impact between the switch shaft 236 and the reset shaft 211 consequently causes the reset shaft 211 to rotate, thereby causing the reset lever 212 to pivot due to the operative coupling between the reset shaft 211 and the reset lever 212. The pivoting of the reset lever 212 consequently causes the claw 216 to pivot, due to the operative coupling between the reset lever 212 and the claw 216. The pivoting of the claw 216 consequently causes the hammer 218 to rotate (the direction of rotation of hammer 218 being counter clockwise, relative to the view shown in FIGS. 8A-8B), due to the operative coupling between the claw 216 and the hammer 218.

Figure 8A:
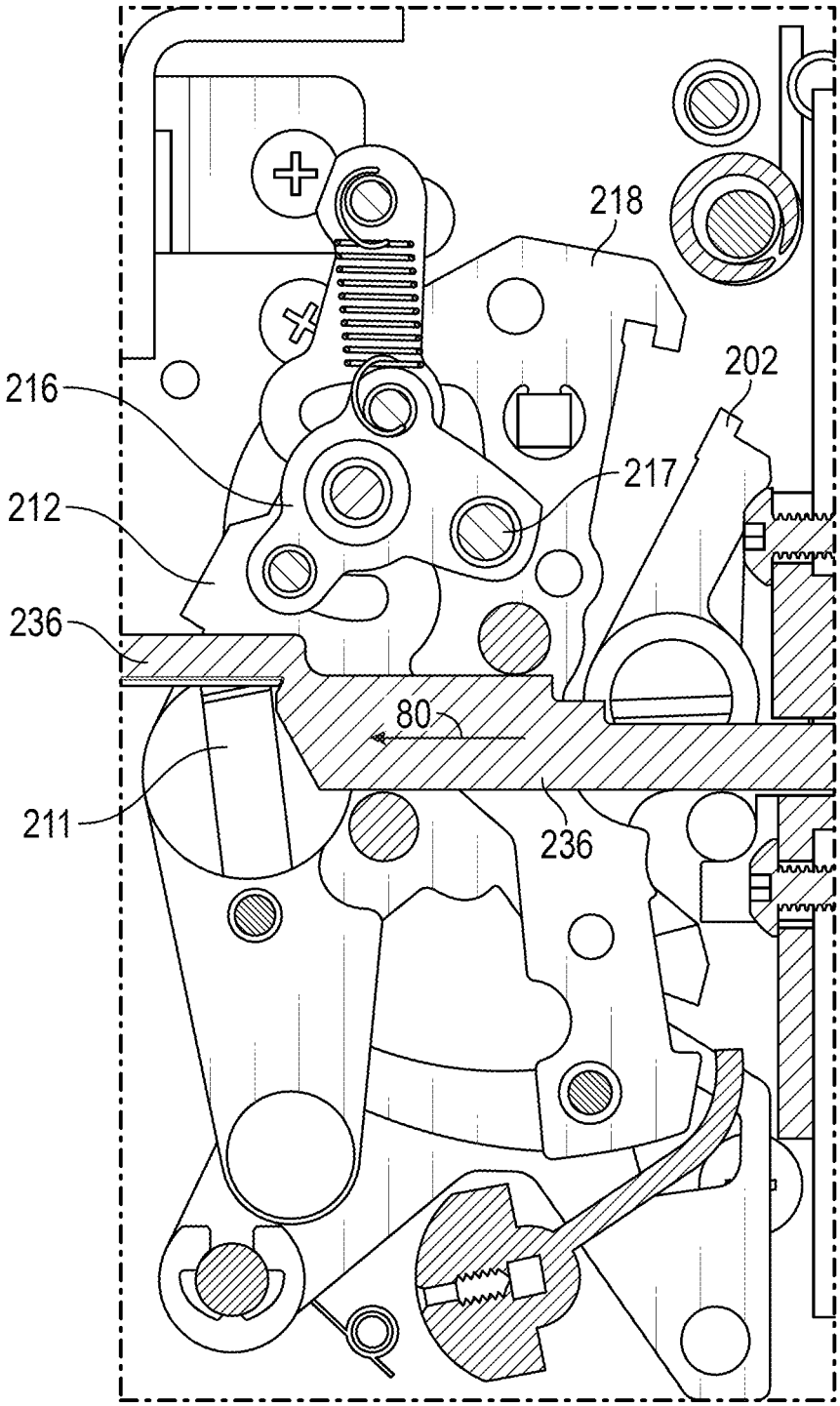
FIG. 8A is a sectional view of a d-shaft style latching assembly that includes the components shown in FIG. 7 and is representative of known latching assemblies used in some circuit interrupters, during an opening stroke of an associated movable conductor assembly, with the sectional view being taken along the line 7S1-7S1 denoted in FIG. 7.
Figure 8B:
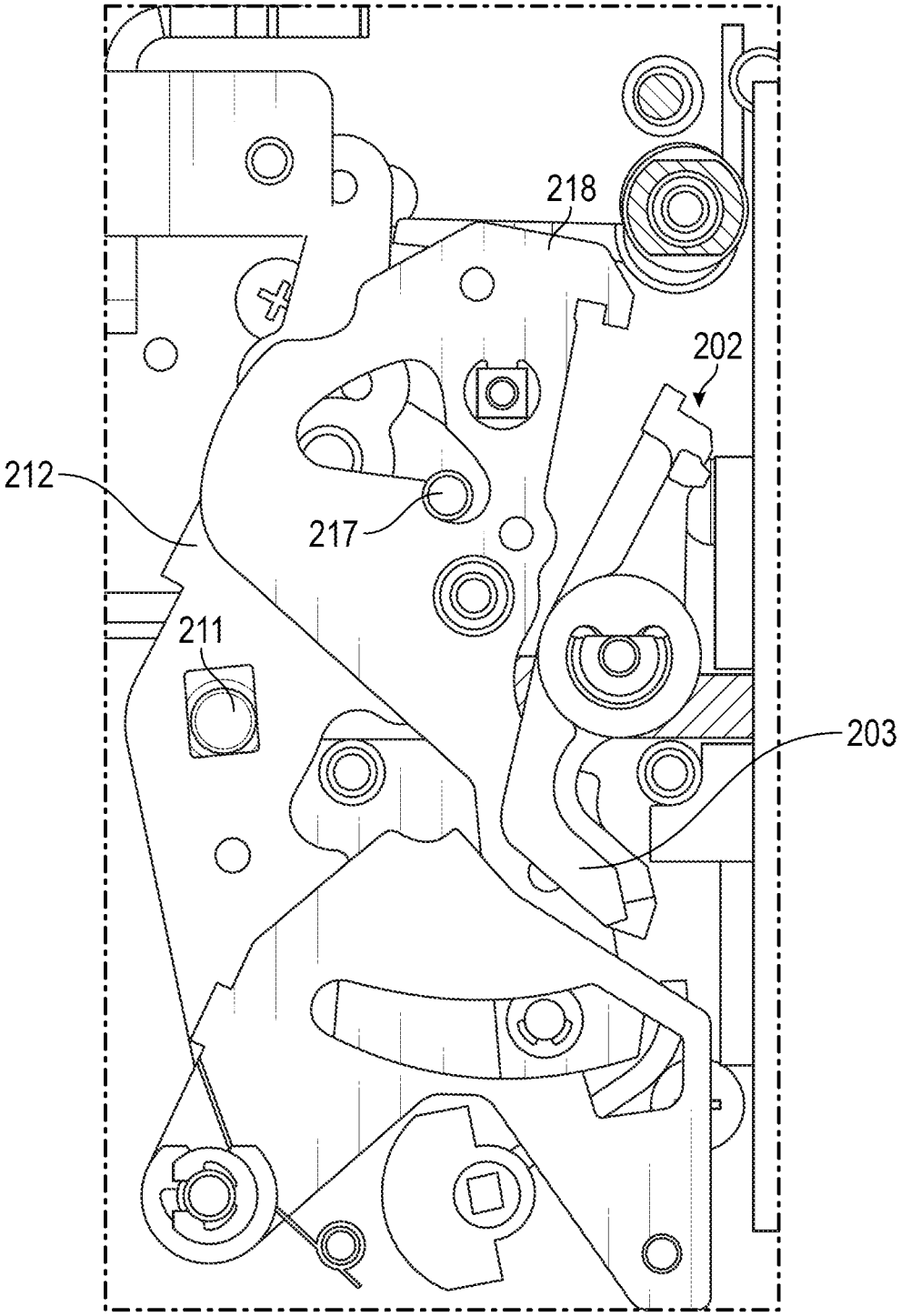
FIG. 8B an alternate sectional view of the latching assembly during the same stage of the opening stroke shown in FIG. 8A taken along the line 7S2-7S2 denoted in FIG. 7.
Figure 9A:
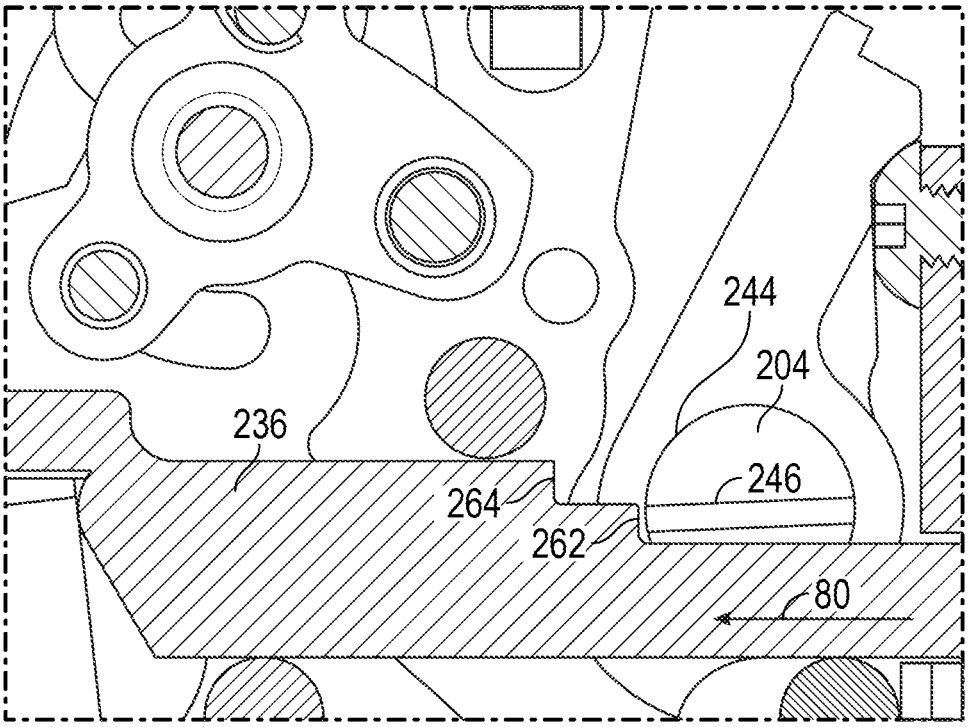
FIG. 9A is an enlarged view of a portion of FIG. 8A showing the alignment between the d-shaft of the d-shaft style latch and a switch shaft of the circuit interrupter during an opening stroke.

FIG. 8A shows the switch shaft 236 moving in the opening direction 80 toward a fully open position after an opening stroke of the associated moving assembly has been initiated, and FIG. 9A shows an enlargement of a portion of FIG. 8A. Referring to FIG. 9A, it will be appreciated that, in order to properly latch the switch shaft 236 and prevent rebounding, in the time between the stage of an opening stroke depicted in FIG. 9A and the end of the opening stroke, the d-shaft latch 202 must pivot far enough such that the d-shaft 204 of the latch 202 can rotate sufficiently for its rounded surface 244 to obstruct a first shelf 262 of the switch shaft 236 from moving a significant distance in the closing direction 90. The degree of rotation of the d-shaft 204 of the d-shaft latch 202 can be gauged visually by the disposition of the flat edge 246 of the d-shaft 242.

Figure 9B:
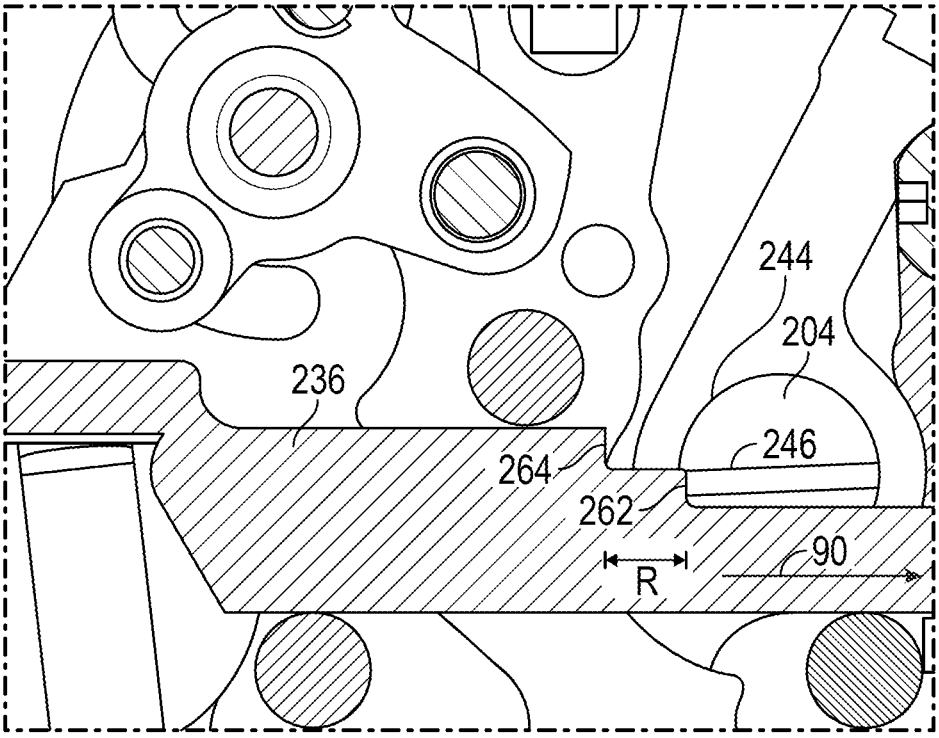
FIG. 9B shows the same portion of the latching assembly shown in FIG. 9A, and depicts the misalignment of the d-shaft and the switch shaft that occurs after a d-shaft style latching assembly fails to latch the switch shaft and the switch shaft has rebounded.

An unsuccessful latching operation is now described with respect to FIG. 9B. While FIG. 9B shows an enlarged view of the same portion of the latching assembly 200 shown in FIG. 9A, FIG. 9B depicts the latching assembly 200 after a malfunction prevents the d-shaft latch 202 from moving into the proper position in enough time to latch the switch shaft 236 after the end of the opening stroke. That is, FIG. 9B depicts an unlatched switch shaft 236 moving in the closing direction 90 at the beginning of a rebound that will result in the moving assembly 38 moving further in the closing direction 90 than desired. Specifically, when the components of the latching assembly 200 do not move quickly enough for the rounded surface 244 of the d-shaft 242 to obstruct the first shelf 262 of the switch shaft 236 from moving in the closing direction 90, as shown in FIG. 9B, the switch shaft 236 then continues to move in the closing direction 90, such that the switch shaft 236 only stops moving in the closing direction 90 once the d-shaft rounded surface 244 obstructs a second shelf 264 of the switch shaft 236. That is, the switch shaft 236 rebounds a distance R (labeled in FIG. 8B) in those instances when the latching assembly 200 fails to prevent the switch shaft 236 from rebounding. Because the ends of the hammer coupling pin 220 extend laterally from the hammer planar sides 219 (see FIG. 7), unintentional rebounding causes the ends of the coupling pin 220 to impact the legs 203 of the d-shaft latch 202, and thus causes damage to the legs 203.

In comparing the driven latch 102 (FIG. 4) to the d-shaft latch 202 (FIG. 7), it is apparent that the latching assembly 100 provides a more streamlined design for a latch. In addition, from the perspective of a lateral plane, the entire driven latch 102 is disposed between the two planar sides 180 of the hammer 118, while significant portions (e.g. the legs 203) of the d-shaft latch 202 are not disposed between the two planar sides 219 of the hammer 218. When the mechanics of the latching assembly 100 (as depicted in FIGS. 5A-5D) and latching assembly 200 (as depicted in FIGS. 6A-8B) are compared, it is apparent that the streamlined design of the driven latch 102 and its disposition in between the planar sides 180 of the hammer 118 eliminate several sources of malfunctions in a latching operation that can occur with the d-shaft latch 202. In addition to preventing unintended rebounding, the omission of the legs 203 and other features of the improved design of driven latch 102 greatly reduce, if not completely eliminate, the opportunities for latch components to be damaged during a latching operation, resulting in significantly reduced maintenance and repair needs.

While specific embodiments of the invention have been described in detail, it will be appreciated by those skilled in the art that various modifications and alternates to those details could be developed in light of the overall teachings of the disclosure. Accordingly, the particular arrangements disclosed are meant to be illustrative only and not limiting as to the scope of disclosed concept which is to be given the full breadth of the claims appended and any and all equivalents thereof.

What is claimed is:

1. A latching assembly for latching a moving conductor assembly of a circuit interrupter, the latching assembly being structured to be disposed within a housing of the circuit interrupter and comprising:
- a latch block structured to be fixedly positioned relative to the circuit interrupter housing;
- a driven latch rotatably coupled to the latch block;
- a hammer, the hammer comprising:
  - two planar sides disposed parallel to one another; and
  - a square pin, the square pin being coupled at a first end to a first of the two planar sides and being coupled a second end to a second of the two planar sides; and
- a rotation pin structured to fixedly position the hammer relative to the circuit interrupter housing and to form a fixed axis about which the hammer can rotate,
- wherein the driven latch is disposed between the two hammer planar sides,
- wherein the driven latch comprises a medial surface structured to face toward a switch shaft of the moving assembly and a lateral surface disposed opposite the medial surface structured to face away from the switch shaft, and
- wherein the hammer and the driven latch are structured such that the hammer square pin is always in engagement with the lateral side of the driven latch.

2. The latching assembly of claim 1,
- wherein the medial surface of the driven latch comprises a closing step and a latching step joined by a riser,
- wherein the closing step is structured to engage the switch shaft when the moving conductor assembly is in a closed state, and
- wherein the riser is structured to engage the switch shaft when the moving conductor assembly is in an open state.

3. The latching assembly of claim 2,
- wherein the lateral side of the driven latch is formed with a notch structured to receive the hammer square pin,
- wherein the latching assembly is structured to latch the switch shaft in either of a fully latched state or a partially latched state in order to maintain the moving conductor assembly in the open state,
- wherein the latching assembly is structured such that, in the partially latched state, the driven latch riser engages the switch shaft and the hammer square pin does not engage the driven latch notch, and
- wherein the latching assembly is structured such that, in the fully latched state, the driven latch riser engages the switch shaft and the hammer square pin engages the driven latch notch.

4. The latching assembly of claim 3,
wherein the latching assembly is structured to latch the switch shaft in the partially latched state if the hammer is unable to rotate sufficiently and quickly enough to latch the switch shaft in the fully latched state.

5. The latching assembly of claim 3,
wherein the lateral surface of the driven latch comprises a curved portion, the curved portion comprising an apex, a distal portion, and a proximal portion,
wherein the distal portion extends from the closing step to the apex,
wherein the proximal portion extends from the apex to the notch,
wherein the latching assembly is structured to generate a moment arm to bias the hammer to rotate to the fully latched state when the square pin is engaged with the proximal portion of the driven latch lateral surface and there is a gap between the switch shaft and the driven latch riser.

6. The latching assembly of claim 3, further comprising:
a reset shaft structured to be engaged by the switch shaft;
a reset lever operatively coupled to the reset shaft;
a claw operatively coupled to the reset lever and operatively coupled to the hammer; and
a claw pin fixedly coupled to the claw,
wherein the reset shaft, the rest lever, and the claw are structured to either rotate or pivot when the reset shaft is pushed by the switch shaft,
wherein the hammer is structured to rotate when the claw pivots,
wherein the hammer comprises a claw pin opening structured to receive the claw pin, the claw pin opening comprising a claw engagement groove structured to engage the claw pin as the hammer rotates to the open state from the closed state,
wherein the claw pin opening is structured to enable the claw pin to disengage from the claw engagement groove while remaining within the claw pin opening as the hammer approaches the fully latched state.

7. The latching assembly of claim 3,
wherein each of the two hammer planar sides comprises a protrusion,
wherein the latch block comprises a number of depressions structured to receive the hammer planar sides protrusions when the latching assembly is disposed in the fully latched state.

8. The latching assembly of claim 1, further comprising:
a guiding pin structured to be fixed in position relative to the circuit interrupter housing and adjacent to the switch shaft,
wherein the latching assembly is configured to position the guiding pin on a side of the switch shaft disposed opposite the rotation pin.

9. The latching assembly of claim 8,
wherein the hammer comprises a divot,
wherein the hammer divot is structured to engage the guiding pin when the latching assembly is in the closed state.

10. A circuit interrupter structured to be electrically connected between a power source and a load, the circuit interrupter comprising:
a housing;
a pair of separable contacts comprising a stationary separable contact and a moving separable contact;
a moving assembly, the moving assembly comprising:
a moving conductor comprising the moving separable contact; and
a switch shaft operably coupled to the moving conductor;
an actuator structured to actuate the moving assembly to open and close the separable contacts;
an electronic trip unit structured to activate the actuator; and
a latching assembly structured to be engaged by the switch shaft and to latch the moving assembly, the latching assembly comprising:
a latch block fixedly positioned relative to the circuit interrupter housing;
a driven latch rotatably coupled to the latch block;
a hammer, the hammer comprising:
two planar sides disposed parallel to one another; and
a square pin, the square pin being coupled at a first end to a first of the two hammer planar sides and being coupled a second end to a second of the two hammer planar sides; and
a rotation pin structured to fixedly couple the hammer to the circuit interrupter housing and to form a fixed axis about which the hammer can rotate,
wherein the driven latch is disposed between the two hammer planar sides,
wherein the driven latch comprises a medial surface structured to face toward the switch shaft and a lateral surface disposed opposite the medial surface structured to face away from the switch shaft, and
wherein the hammer and the driven latch are structured such that the hammer square pin is always in engagement with the lateral surface of the driven latch.

11. The circuit interrupter of claim 10,
wherein the switch shaft comprises at least two portions of differing widths, a first portion of a first width and a second portion of a second width, the second width being greater than the first width,
wherein the switch shaft further comprises a shelf formed by the meeting of the first portion with the second portion,
wherein the medial surface of the driven latch comprises two steps, a closing step and a latching step,
wherein the medial surface of the driven latch further comprises a riser that joins the closing step and the latching step,
wherein the closing step of the driven latch is structured to engage the switch shaft when the latching assembly is in a closed state, and
wherein the riser of the drive latch is structured to engage the switch shaft shelf when the latching assembly is in a latched state.

12. The circuit interrupter of claim 11,
wherein the lateral surface of the driven latch is formed with a notch structured to receive the hammer square pin,
wherein the latching assembly is structured to latch the switch shaft in either of a fully latched state or a partially latched state in order to maintain the moving conductor assembly in the open state,
wherein the latching assembly is structured such that, in the partially latched state, the hammer square pin does not engage the notch of the driven latch, and
wherein the latching assembly is structured such that, in the fully latched state, the hammer square pin does engage the driven latch notch.

13. The circuit interrupter of claim 12,
wherein the latching assembly is structured to latch the switch shaft in the partially latched state if the hammer is unable to rotate sufficiently and quickly enough to latch the switch shaft in the fully latched state.

14. The circuit interrupter of claim 12, further comprising:

a slow solenoid;

a solenoid paddle comprising an arm, the solenoid paddle being structured to be activated by the slow solenoid;

a closing solenoid; and a hammer cam assembly structured to be powered by the closing solenoid, wherein the hammer further comprises a cam engagement pin structured to be engaged by the hammer cam assembly and a paddle engagement pin structured to be engaged by the solenoid paddle arm, wherein the circuit interrupter is configured to activate the slow solenoid and the closing solenoid when a determination has been made to unlatch and re-close the moving conductor assembly, wherein the slow solenoid arm is structured to rotate and engage the paddle engagement pin when the slow solenoid is activated, wherein the hammer is structured to rotate toward an open position when the paddle engagement pin is engaged by the rotation of the slow solenoid arm, wherein the hammer is structured such that the rotation of the hammer from the engagement of the paddle engagement pin by the solenoid paddle arm hammer consequently rotates the cam engagement pin into engagement with the hammer cam assembly, wherein the hammer cam assembly is structured to exert force on the cam engagement pin to rotate the hammer to the closed state when the closing solenoid is activated.

15. The circuit interrupter of claim 14, wherein the square pin is structured to disengage from the notch of the driven latch during the rotation of the hammer by the solenoid paddle arm, and wherein the driven latch is structured to disengage the riser from the switch shaft shelf as the square pin disengages from the notch.

16. The circuit interrupter of claim 12, wherein the lateral surface of the driven latch comprises a curved portion, the curved portion comprising an apex, a distal portion, and a proximal portion, wherein the distal portion extends from the closing step to the apex, wherein the proximal portion extends from the apex to the notch, wherein the latching assembly is structured to generate a moment arm to bias the hammer to rotate to the fully latched state when the square pin is engaged with the proximal portion of the driven latch lateral surface and there is a gap between the switch shaft and the driven latch riser.

17. The circuit interrupter of claim 12, wherein the latching assembly further comprises:

a reset shaft structured to be engaged by the switch shaft;

a reset lever operatively coupled to the reset shaft;

a claw operatively coupled to the reset lever and operatively coupled to the hammer; and a claw pin fixedly coupled to the claw, wherein the reset shaft, the rest lever, and the claw are structured to either rotate or pivot when the reset shaft is pushed by the switch shaft, wherein the hammer is structured to rotate when the claw pivots, wherein the hammer comprises a claw pin opening structured to receive the claw pin, the claw pin opening comprising a claw engagement groove structured to engage the claw pin as the hammer rotates to the open state from the closed state, wherein the claw pin opening is structured to enable the claw pin to disengage from the claw engagement groove while remaining within the claw pin opening as the hammer approaches the fully latched state.

18. The circuit interrupter of claim 10, further comprising:

a mounting block fixedly positioned relative to the circuit interrupter housing; and a guiding pin fixedly positioned relative to the circuit interrupter housing, wherein the mounting block is positioned adjacent to the latch block so as to be positioned laterally relative to the switch shaft on a side of the switch shaft disposed opposite the latch block, and wherein the guiding pin is positioned adjacent to the switch shaft on a side of the switch saft disposed opposite the mounting block.

19. A latching assembly for latching a moving conductor assembly of a circuit interrupter, the latching assembly being structured to be disposed within a housing of the circuit interrupter and comprising:

a latch block structured to be fixedly positioned relative to the circuit interrupter housing;

a driven latch rotatably coupled to the latch block;

a hammer, the hammer comprising:

two planar sides disposed parallel to one another;

a square pin, the square pin being coupled at a first end to a first of the two planar sides and being coupled a second end to a second of the two planar sides; and a plurality of rounded pins, each of the rounded pins being coupled at a first end to a first of the two planar sides and being coupled a second end to a second of the two planar sides, the plurality of rounded pins comprising:

a paddle engagement pin coupled to a first end of each of the two planar sides;

a cam engagement pin coupled to a second end of each of the two planar sides disposed opposite the first end; and a number of interior hammer pins coupled to the planar sides in between the square pin and the cam engagement pin; and a rotation pin structured to fixedly position the hammer relative to the circuit interrupter housing and to form a fixed axis about which the hammer can rotate, wherein the latching assembly is structured so as to receive a switch shaft of the moving conductor assembly in between the square pin and the interior hammer pins, wherein the driven latch is disposed between the two hammer planar sides, wherein the driven latch comprises a medial surface structured to face toward the switch shaft and a lateral surface disposed opposite the medial surface structured to face away from the switch shaft, wherein the lateral side of the driven latch is formed with a notch structured to receive the hammer square pin, and wherein the hammer and the driven latch are structured such that the hammer square pin is always in engagement with the lateral surface of the driven latch.

20. The latching assembly of claim 19, wherein the medial surface of the driven latch comprises a closing step and a latching step joined by a riser, wherein the closing step is structured to engage the switch shaft when the moving conductor assembly is in a closed state, wherein the riser is structured to engage the switch shaft when the moving conductor assembly is in an open state, wherein the latching assembly is structured to latch the switch shaft in either of a partially latched state or a fully latched state in order to maintain the moving conductor assembly in the open state, wherein the latching assembly is structured such that, in the partially latched state, the driven latch riser engages the switch shaft and the hammer square pin does not engage the driven latch notch, and wherein the latching assembly is structured such that, in the fully latched state, the driven latch riser engages the switch shaft and the hammer square pin engages the driven latch notch.

* * * * *